US012523015B2

(12) United States Patent
Fukuchi et al.

(10) Patent No.: US 12,523,015 B2
(45) Date of Patent: Jan. 13, 2026

(54) WORK MACHINE

(71) Applicant: Hitachi Construction Machinery Co., Ltd., Tokyo (JP)

(72) Inventors: Ryohei Fukuchi, Tsukuba (JP); Katsuaki Kodaka, Tsukuba (JP); Mitsuhiko Kanehama, Kasumigaura (JP); Teruki Igarashi, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 170 days.

(21) Appl. No.: 18/282,925

(22) PCT Filed: Mar. 11, 2022

(86) PCT No.: PCT/JP2022/011141
§ 371 (c)(1),
(2) Date: Sep. 19, 2023

(87) PCT Pub. No.: WO2022/196595
PCT Pub. Date: Sep. 22, 2022

(65) Prior Publication Data

US 2024/0254728 A1 Aug. 1, 2024

(30) Foreign Application Priority Data

Mar. 19, 2021 (JP) ..... 2021-046477

(51) Int. Cl.
*E02F 9/22* (2006.01)
*E02F 3/32* (2006.01)

(52) U.S. Cl.
CPC ..... *E02F 9/2292* (2013.01); *E02F 9/2242* (2013.01); *E02F 3/32* (2013.01)

(58) Field of Classification Search
CPC ..... E02F 9/2292; E02F 9/2242; E02F 3/32; E02F 3/435; E02F 9/226; E02F 9/2285;
(Continued)

(56) References Cited

U.S. PATENT DOCUMENTS 10,329,739 B2 6/2019 Hoshino et al.
2001/0042849 A1* 11/2001 Yamamoto ..... F15B 21/041 251/129.05
(Continued)

FOREIGN PATENT DOCUMENTS

JP 63-43078 A 2/1988
JP 9-195805 A 7/1997
(Continued)

OTHER PUBLICATIONS

International Preliminary Report on Patentability (PCT/IB/338 & PCT/IB/373) issued in PCT Application No. PCT/JP2022/011141 dated Sep. 28, 2023, including English translation of Written Opinion (PCT/ISA/237) (6 pages).
(Continued)

*Primary Examiner* — Jelani A Smith
*Assistant Examiner* — Alyssa Rorie
(74) *Attorney, Agent, or Firm* — Crowell & Moring LLP

(57) ABSTRACT

A work machine includes: a first pump and a second pump that are driven by an engine; a hydraulic actuator driven by a hydraulic working fluid supplied from the first pump; a control valve that controls a flow of the hydraulic working fluid supplied to the hydraulic actuator; a solenoid valve that reduces a pressure of the second pump to generate a pilot pressure for operating the control valve; a controller that controls the solenoid valve; an engine operating section that enables operation for activating the engine; and a rotation speed sensor that senses a rotation speed of the engine. The controller applies a drive current to the solenoid valve to drive the solenoid valve when a current application condition is established, the current application condition including that it is assessed, on the basis of a sensing result of the rotation speed sensor, that the engine is in a stopped state, and including that ON operation of the engine operating
(Continued)

section is performed in a state where activation operation is not performed by the engine operating section.

5 Claims, 13 Drawing Sheets

(58) Field of Classification Search
CPC ..... E02F 9/2296; E02F 9/2228; E02F 9/2221; E02F 9/2267; E02F 9/2271; F15B 21/041; F15B 21/082; F15B 21/087; F15B 13/0433; F15B 2211/20523; F15B 2211/20546; F15B 2211/20576; F15B 2211/20584; F15B 2211/3116; F15B 2211/327; F15B 2211/329; F15B 2211/355; F15B 2211/50554; F15B 2211/615; F15B 2211/633; F15B 2211/6343; F15B 2211/6346; F15B 2211/6355; F15B 2211/6651; F15B 2211/6658; F15B 2211/85; F15B 11/08; B60Y 2200/412
See application file for complete search history.

(56) References Cited

U.S. PATENT DOCUMENTS

2009/0077839 A1* 3/2009 Horii ..... E02F 9/2292 37/443
2011/0240146 A1* 10/2011 Kawasaki ..... E02F 9/2296 137/487.5
2013/0004279 A1* 1/2013 Naito ..... B60T 13/22 188/170
2020/0308808 A1* 10/2020 Nakajima ..... E02F 9/2228
2021/0010228 A1* 1/2021 Izumikawa ..... E02F 3/435
2022/0205464 A1* 6/2022 Muraoka ..... F15B 19/00
2024/0060270 A1* 2/2024 Kaneda ..... E02F 9/2228

FOREIGN PATENT DOCUMENTS

JP 2001-324047 A 11/2001
JP 2005-299676 A 10/2005
KR 10-2015-0139655 A 12/2015
WO WO 2020/235242 A1 11/2020

OTHER PUBLICATIONS

Extended European Search Report issued in European Application No. 22771342.7 dated Jan. 23, 2025 (10 pages).
International Search Report (PCT/ISA/210) issued in PCT Application No. PCT/JP2022/011141 dated May 17, 2022 with English translation (4 pages).
Japanese-language Written Opinion (PCT/ISA/237) issued in PCT Application No. PCT/JP2022/011141 dated May 17, 2022 with English translation (7 pages).
Korean-language Office Action issued in Korean Application No. 10-2023-7032055 dated Oct. 21, 2025 with English translation (12 pages).

* cited by examiner

FIG. 5

| | | STATE OF ENGINE | | OPERATION POSITION OF IGNITION SWITCH | | | |
|---|---|---|---|---|---|---|---|
| No. | CURRENT APPLICATION FLAG | IN OPERATION | STOPPED | OFF | ACC | ON | START |
| 1 | OFF | — | ○ | ○ | — | — | — |
| 2 | OFF | — | ○ | — | ○ | — | — |
| 3 | ON | — | ○ | — | — | ○ | — |
| 4 | ON | — | — | — | — | — | ○ |
| 5 | OFF | ○ | — | — | — | — | ○ |
| 6 | OFF | ○ | — | — | — | ○ | |

WORK MACHINE

TECHNICAL FIELD

The present invention relates to a work machine such as a hydraulic excavator that reduces silting that occurs between a spool and a valve body.

BACKGROUND ART

There is a known technology aimed for preventing silting which is a phenomenon of accumulation of foreign matters mixed in the hydraulic fluid between the spool and the valve body in a device including: a solenoid valve that causes the spool to slide relative to the valve body in accordance with a control current command, and outputs a hydraulic fluid according to the movement position of the spool; and control target equipment that is actuated in accordance with the hydraulic fluid output from the solenoid valve (see Patent Document 1).

According to the content of the technology described in Patent Document 1, there is disclosed that the correspondence between current values and the duration of time, which is current commands to the solenoid valve determined within a range that the control target equipment is not actuated, is set in advance, and a silting prevention current command is given to the solenoid valve on the basis of the correspondence set in advance. Furthermore, according to the content of the technology, there is disclosed that hydraulic actuators such as hydraulic cylinders, hydraulic pumps, or hydraulic motors are treated as control targets, and a silting preventing process is performed within a range that the hydraulic actuators are not actuated.

PRIOR ART DOCUMENT

Patent Document

Patent Document 1: JP-2001-324047-A

SUMMARY OF THE INVENTION

Problem to be Solved by the Invention

Regarding the technology described in Patent Document 1, since the silting preventing process is performed within a range that the hydraulic actuators are not actuated while an engine is in operation, there is a constraint that the movement amounts of the spools of solenoid valves cannot be increased. Because of this, according to the technology described in Patent Document 1, there is a fear that foreign matters between the spool of a solenoid valve and a retaining member that retains the spool slidably cannot be removed sufficiently. As a result, there is a fear that the solenoid valve gets stuck due to biting of the foreign matters, and malfunctions of the hydraulic actuator may be caused. Note that, in order to sufficiently remove foreign matters, if the movement amount of the spool of a solenoid valve is increased in the technology described in Patent Document 1, there is a fear that an action of the solenoid valve for removing the foreign matters influences an action of the hydraulic actuator undesirably.

An object of the present invention is to provide a work machine that can more effectively remove foreign matters in solenoid valves without influencing actions of hydraulic actuators.

Means for Solving the Problem

A work machine according to an aspect of the present invention includes: an engine; a first pump and a second pump that are driven by the engine; a hydraulic actuator driven by a hydraulic working fluid supplied from the first pump; a control valve that controls a flow of the hydraulic working fluid supplied from the first pump to the hydraulic actuator; a solenoid valve that reduces a pressure of the hydraulic working fluid supplied from the second pump to generate a pilot pressure for operating the control valve; a controller that controls the solenoid valve; an engine operating section that enables operation for activating the engine; and a rotation speed sensor that senses a rotation speed of the engine. The controller is configured to: assess whether or not a current application condition is established, the current application condition including that it is assessed, on a basis of a sensing result of the rotation speed sensor, that the engine is in a stopped state, and including that ON operation of the engine operating section is performed in a state where activation operation is not performed by the engine operating section; and apply a drive current to the solenoid valve to drive the solenoid valve when it is assessed that the current application condition is established.

Advantages of the Invention

The present invention can provide a work machine that can more effectively remove foreign matters in solenoid valves without influencing actions of hydraulic actuators.

BRIEF DESCRIPTION OF THE DRAWINGS

FIG. 5 is a table representing the relationship among states of an engine, operation positions of an ignition switch, and ON/OFF states of a current application flag.

MODES FOR CARRYING OUT THE INVENTION

A work machine according to embodiments of the present invention is explained with reference to the figures. In examples explained in the present embodiments, the work machine is a crawler type hydraulic excavator. The work machine performs work such as engineering work, construction work, demolition work, or dredging work at a work site.

First Embodiment

Figure 1:
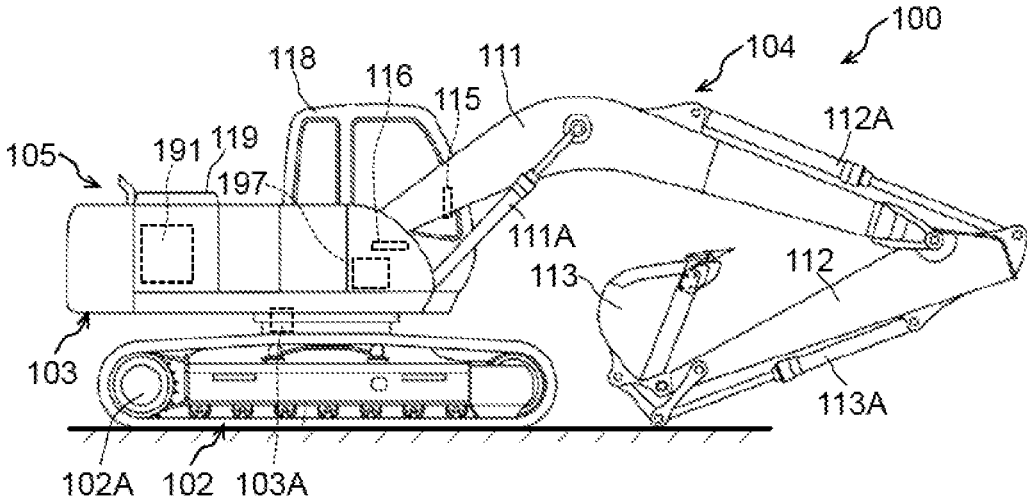
FIG. 1 is a side view of a hydraulic excavator according to a first embodiment.

FIG. 1 is a side view of a hydraulic excavator 100 according to a first embodiment. As depicted in FIG. 1, the hydraulic excavator 100 includes a machine body 105 and a work implement 104 attached to the machine body 105. The machine body 105 has a crawler type travel structure 102 and a swing structure 103 provided swingably on the travel structure 102. The travel structure 102 travels when a pair of left and right crawlers are driven by travel motors 102A. The swing structure 103 is coupled to the travel structure 102 via a swing device having a swing motor 103A, and pivots (swings) relative to the travel structure 102 by being driven by the swing motor 103A.

The swing structure 103 includes an operation room 118 where an operator gets in and an engine compartment 119 housing an engine 191, which is a prime mover, and hydraulic equipment such as hydraulic pumps driven by the engine 191. A starter motor 196 (see FIG. 2) for activating the engine 191 and a battery 197 that supplies electric power to various types of device are provided in the engine compartment 119. For example, the battery 197 is a power storage device including a plurality of lithium ion secondary batteries as electric power storage elements.

An ignition switch 188 (see FIG. 2), which is an engine operating section that enables operation for activating or stopping the engine 191, and electric operation devices for operating hydraulic actuators (111A, 112A, 113A, 103A, and 102A) of the work implement 104, the swing structure 103, and the travel structure 102 are provided in the operation room 118. In addition, a machine body controller 120 (see FIG. 2), which is a controller that controls basic actions of the hydraulic excavator 100, an engine controller 190 (see FIG. 2), which is a controller that controls the rotation speed (revolution speed) of the engine 191, and an operation controller 150 (see FIG. 2), which is a controller that controls the activation, stop, and the like of the engine 191, are provided in the operation room 118.

Figure 2:
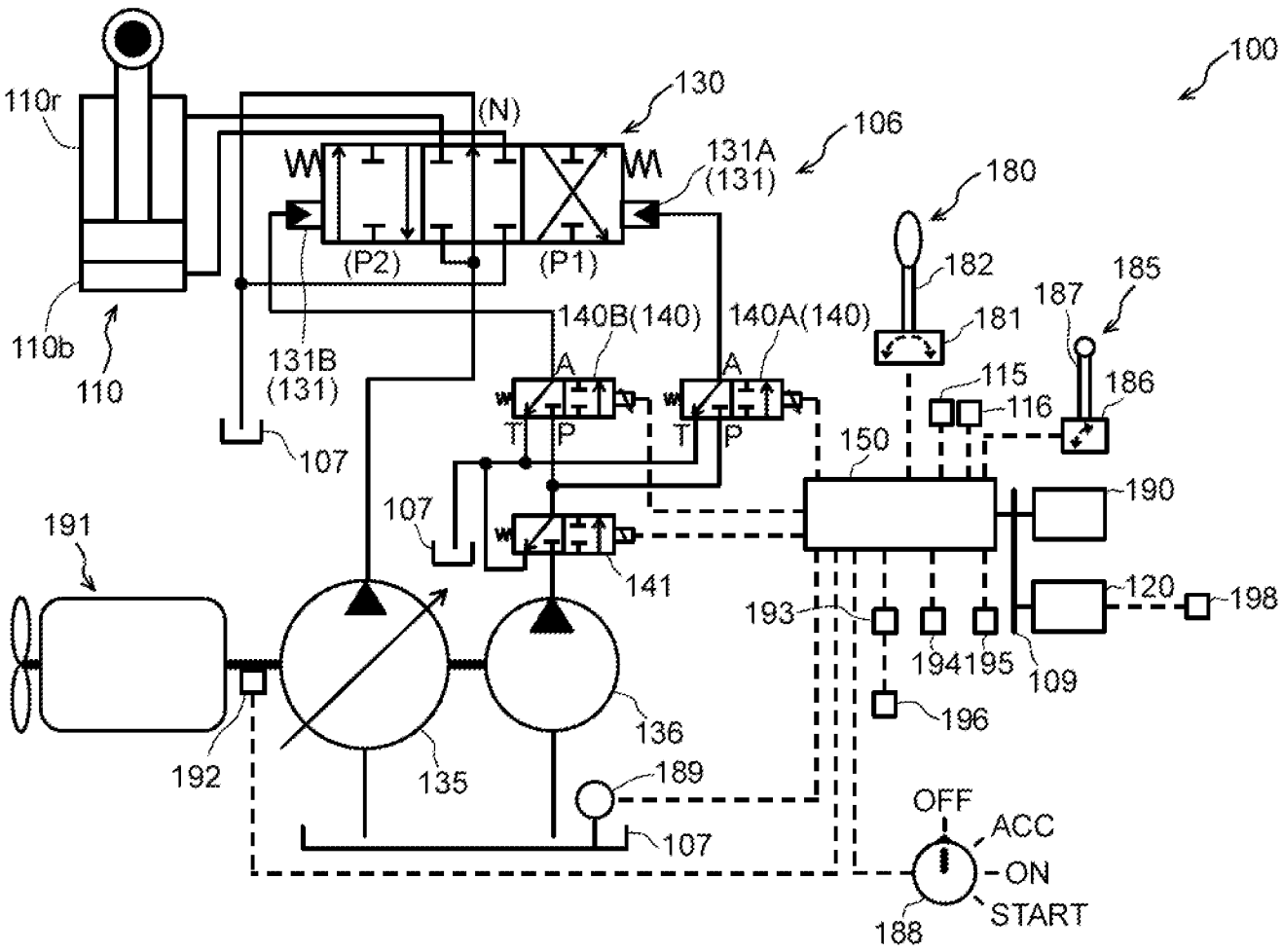
FIG. 2 is a figure depicting a hydraulic system included in the hydraulic excavator according to the first embodiment.

As depicted in FIG. 2, the operation controller 150, the machine body controller 120, and the engine controller 190 are connected mutually communicatively via an in-vehicle network 109 called CAN (Controller Area Network). Note that the in-vehicle network 109 may use a communication standard other than CAN, for example, Ethernet (registered trademark).

As depicted in FIG. 1, a display device 115 that displays images representing the operational state of the hydraulic excavator 100 and an input device 116 for operating the display device 115 and the like are provided in the operation room 118. The display device 115 is a liquid crystal display device, an organic EL display device, or the like, and the input device 116 has a plurality of switches, operation sticks, and the like. Note that the input device 116 may be a touch sensor formed on a display of the display device 115. That is, the hydraulic excavator 100 may include a touch panel monitor that functions as the display device 115 and the input device 116.

The work implement 104 is an articulated type work implement attached to the swing structure 103, and has a plurality of hydraulic actuators and a plurality of driven members (front implement members) driven by the plurality of hydraulic actuators. The work implement 104 has configuration in which three driven members (a boom 111, an arm 112, and a bucket 113) are coupled in series. The base end of the boom 111 is pivotably coupled to the front of the swing structure 103 via a boom pin. The base end of the arm 112 is pivotably coupled to the distal end of the boom 111 via an arm pin. The bucket 113 is pivotably coupled to the distal end of the arm 112 via a bucket pin.

The boom 111 is rotation-driven by an extension/contraction action of a boom cylinder 111A, which is a hydraulic actuator (hydraulic cylinder). The arm 112 is rotation-driven by an extension/contraction action of an arm cylinder 112A, which is a hydraulic actuator (hydraulic cylinder). The bucket 113 is rotation-driven by an extension/contraction action of a bucket cylinder 113A, which is a hydraulic actuator (hydraulic cylinder). The hydraulic excavator 100 can perform earth and sand excavation work, levelling work, rolling compaction work for compacting grounds, or the like by causing the work implement 104 to perform an action.

FIG. 2 is a figure depicting a hydraulic system (hydraulic drive circuit) 106 included in the hydraulic excavator 100 according to the first embodiment. Note that the travel motors (hydraulic motors) 102A, the swing motor (hydraulic motor) 103A, the boom cylinder (hydraulic cylinder) 111A, the arm cylinder (hydraulic cylinder) 112A, and the bucket cylinder (hydraulic cylinder) 113A mounted on the hydraulic excavator 100 are collectively written also as a hydraulic actuator below. The hydraulic excavator 100 has a plurality of hydraulic actuators, and FIG. 2 representatively depicts a hydraulic cylinder 110 (e.g. the boom cylinder 111A) for driving a driven member of the work implement 104. In addition, an electric operation device 180 for operating a hydraulic actuator, and solenoid proportional valves 140A and 140B, and a directional control valve (also referred to as a flow rate control valve) 130 that are driven in accordance with operation of the operation device 180 are provided for a plurality of hydraulic actuators, and FIG. 2 representatively depicts only configuration for controlling the one hydraulic actuator.

The hydraulic system 106 includes: a main pump 135, which is a first pump, and a pilot pump 136, which is a second pump; the hydraulic cylinder 110 driven by a hydraulic working fluid as a working fluid supplied from the main pump 135; the directional control valve 130, which is a control valve that controls a flow of the hydraulic working fluid supplied from the main pump 135 to the hydraulic cylinder 110; the solenoid proportional valves 140A and 140B that reduce the pressure of the hydraulic working fluid supplied from the pilot pump 136 to generate a pilot pressure (hereinafter, written also as a command pilot pressure) for operating the directional control valve 130; and a tank 107 that stores the hydraulic working fluid. The directional control valve 130 has: a pressure receiving section 131A that receives a command pilot pressure introduced from the solenoid proportional valve 140A; and a pressure receiving section 131B that receives a command pilot pressure introduced from the solenoid proportional valve 140B. The pressure receiving sections 131A and 131B are collectively written also as a pressure receiving section 131 below. In addition, the solenoid proportional valves 140A and 140B are collectively written also as a solenoid proportional valve 140.

The main pump 135 and the pilot pump 136 are connected to the engine 191, are driven by the engine 191, and deliver the hydraulic working fluid sucked up from the tank 107. The main pump 135 is a variable displacement hydraulic pump, and the pilot pump 136 is a fixed displacement hydraulic pump. The engine 191 is a motive power source of the hydraulic excavator 100, and includes an internal combustion engine such as a diesel engine, for example. The rotation speed of the engine 191 is sensed by a rotation speed sensor 192 such as a pickup sensor.

Figure 4:
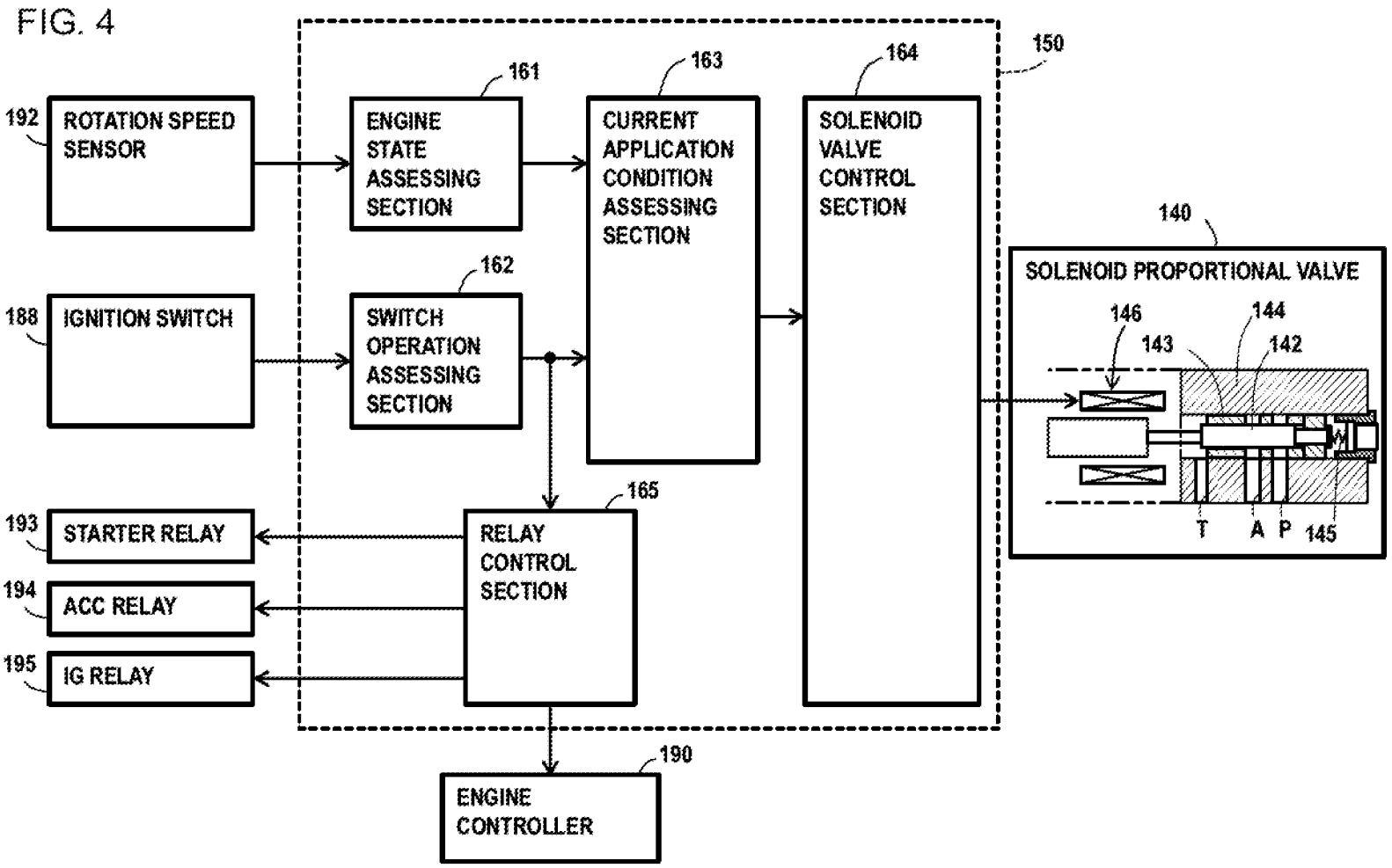
FIG. 4 is a functional block diagram of the operation controller according to the first embodiment.

As depicted in FIG. 4 schematically, the solenoid proportional valve 140 is a well-known solenoid proportional pilot pressure reducing valve having: a spool 142 as the valve body; a sleeve 143 which is a retaining member that retains the spool 142 slidably; a solenoid 146 that gives thrust to the spool 142; and a spring 145, which is an urging member that gives an urging force against the thrust of the solenoid 146 to the spool 142.

The sleeve 143 is fixed to a hole of a valve block 144. A T port, an A port, and a P port are formed through the sleeve 143 and the valve block 144. The P port is connected to the pilot pump 136, the T port is connected to the tank 107, and the A port is connected to the pressure-receiving section 131 of the directional control valve 130.

The spool 142 is stroked between a fully closed position at which the spool 142 interrupts communication between the P port and the A port, and establishes communication between the A port and the T port, and a fully opened position at which the spool 142 interrupts communication between the A port and the T port, and the opening area, over which communication is established between the P port and the A port, is maximized. Note that grooves, notches, holes, or the like formed in or through the spool 142, the sleeve 143, and the valve block 144 for establishing communication between the ports depending on the position of the spool 142 are omitted in FIG. 4.

As depicted in FIG. 2, the solenoid proportional valve 140 generates a command pilot pressure (pilot secondary pressure) by reducing the delivery pressure (pilot primary pressure) of the pilot pump 136, which is a pilot hydraulic pressure source. The command pilot pressure generated at the solenoid proportional valve 140 is introduced to the pressure-receiving section 131 of the directional control valve 130. The solenoid proportional valve 140 is controlled on the basis of a signal from the operation controller 150 or the machine body controller 120.

The operation device 180 gives instructions about actions of the work implement 104, the swing structure 103, and the travel structure 102 in accordance with operation by an operator, and has an operation lever (operation member) 182 that can be operated to incline and an operation sensor 181 that outputs an operation signal according to the operation amount (operation angle) of the operation lever 182 to the operation controller 150.

The machine body controller 120 acquires an operation signal from the operation controller 150 via the in-vehicle network 109. Note that the machine body controller 120 may acquire an operation signal directly from the operation sensor 181. The machine body controller 120 controls the solenoid proportional valve 140 on the basis of a sensing result of the operation sensor 181. Note that the machine body controller 120 may control the solenoid proportional valve 140 via the operation controller 150 or may output a control current directly to the solenoid proportional valve 140 to control the solenoid proportional valve 140.

When a command pilot pressure generated by the solenoid proportional valve 140A acts on the pressure-receiving section 131A of the directional control valve 130 positioned at a neutral position (N), the directional control valve 130 is driven in one direction, and the directional control valve 130 is switched from the neutral position (N) to a first position (P1). Thus, the hydraulic fluid delivered from the main pump 135 is introduced to a bottom chamber 110*b* of the hydraulic cylinder 110 (e.g. the boom cylinder 111A), also the hydraulic working fluid is discharged from a rod chamber 110*r* to the tank 107, and the hydraulic cylinder 110 (e.g. the boom cylinder 111A) is extended. As a result, the driven member (e.g. the boom 111) pivots in a first direction (upward direction).

When a command pilot pressure generated by the solenoid proportional valve 140B acts on the pressure receiving section 131B of the directional control valve 130 positioned at the neutral position (N), the directional control valve 130 is driven in the other direction, and the directional control valve 130 is switched from the neutral position (N) to a second position (P2). Thus, the hydraulic fluid delivered from the main pump 135 is introduced to the rod chamber 110*r* of the hydraulic cylinder 110 (e.g. the boom cylinder 111A), also the hydraulic working fluid is discharged from the bottom chamber 110*b* to the tank 107, and the hydraulic cylinder 110 (e.g. the boom cylinder 111A) is contracted. As a result, the driven member (e.g. the boom 111) pivots in a second direction (downward direction).

In this manner, the hydraulic working fluid delivered from the main pump 135 is supplied through the directional control valve 130 to the hydraulic cylinder 110, and the hydraulic cylinder 110 is driven. Note that although not depicted, the hydraulic working fluid delivered from the main pump 135 is supplied through the directional control valve 130 to the swing motor 103A and the travel motors 102A, and the swing structure 103 and the travel structure 102 are driven, respectively.

A gate lock lever device 185 has: a gate lock lever 187 and an operation position sensor 186 that senses an operation position of the gate lock lever 187, and outputs the operation position to the operation controller 150. A solenoid selector valve (hereinafter, written a lock valve) 141 that is switched between a communication position at which the solenoid selector valve 141 establishes communication, through a pilot line, between the pilot pump 136 and the solenoid proportional valve 140 and an interruption position at which the solenoid selector valve 141 interrupts communication, through the pilot line, depending on the operation position of the gate lock lever 187 is provided on the pilot line.

When the gate lock lever 187 is operated to the unlock position (lowered position), a communication signal is output from the operation controller 150 to a lock valve 141. Thus, the lock valve 141 is switched to the communication position. Because of this, in a state where the gate lock lever 187 is at the unlock position, a command pilot pressure according to the operation amount of the operation lever 182 is generated by the solenoid proportional valve 140, and a hydraulic actuator corresponding to the operated operation lever 182 performs an action. That is, when the gate lock lever 187 is operated to the unlock position (lowered position), actuator actions by the operation device 180 are enabled.

When the gate lock lever 187 is operated to the lock position (raised position), an interruption signal is output from the operation controller 150 to the lock valve 141.

Thus, the lock valve 141 is switched to the interruption position. Because of this, the supply of the pilot primary pressure from the pilot pump 136 to the solenoid proportional valve 140 is interrupted, and operation by the operation lever 182 is disabled. That is, when the gate lock lever 187 is operated to the lock position (raised position), actuator actions by the operation device 180 are disabled.

A temperature sensor 189 that senses the temperature of the hydraulic working fluid supplied to the solenoid proportional valve 140 is attached to the tank 107. Note that the installation location of the temperature sensor 189 is not limited to the tank 107. For example, the temperature sensor 189 may be provided on the pilot line connecting the pilot pump 136 and the solenoid proportional valve 140.

Figure 3:
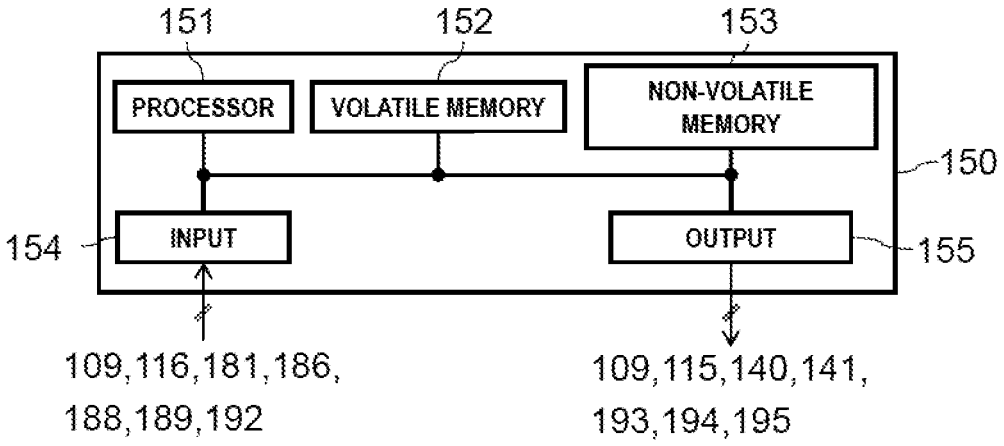
FIG. 3 is a hardware configuration diagram of an operation controller.

The operation controller 150 controls the solenoid proportional valve 140 on the basis of the operation position of the ignition switch 188 and the state of the engine 191, in addition to control for the activation and stop of the engine 191. FIG. 3 is a hardware configuration diagram of the operation controller 150. As depicted in FIG. 3, the operation controller 150 is configured from a computer including: a processor 151 such as a CPU (Central Processing Unit), an MPU (Micro Processing Unit), or a DSP (Digital Signal Processor); a volatile memory 152 which is a so-called RAM (Random Access Memory); a non-volatile memory 153 such as a ROM (Read Only Memory), a flash memory, or a hard disk drive; an input interface 154; an output interface 155; and other peripheral circuits. Note that the operation controller 150 may be configured from one computer or may configured from a plurality of computers.

The non-volatile memory 153 has stored therein programs that can execute various types of computation. That is, the non-volatile memory 153 is a storage medium from which programs to realize functions of the present embodiment can be read out. The processor 151 is a processing device that loads the programs stored in the non-volatile memory 153 onto the volatile memory 152 to execute computations, and performs predetermined computation processes on signals taken in through or from the input interface 154, the volatile memory 152, and the non-volatile memory 153 in accordance with the programs.

The input interface 154 converts an input signal into data on which the processor 151 can perform a computation. In addition, the output interface 155 generates a signal for output according to a result of computation at the processor 151, and outputs the signal to a device such as the solenoid proportional valve 140.

Although not depicted, the machine body controller 120 and the engine controller 190 are each configured from a computer including a processor, a volatile memory, a non-volatile memory, an input interface, an output interface, and other peripheral circuits, similarly to the operation controller 150.

The machine body controller 120 controls an action of the hydraulic actuator on the basis of an operation signal from the operation sensor 181. The machine body controller 120 converts an operation signal from the operation sensor 181 into a lever operation amount. For example, the lever operation amount is represented by a value that is assumed to be 0 [%] when the operation lever 182 is at the neutral position, and is assumed to be 100 [%] when the operation lever 182 is at a full lever position (maximum operation). The machine body controller 120 computes a demanded pilot pressure of the solenoid proportional valve 140 on the basis of the lever operation amount.

The machine body controller 120 converts the demanded pilot pressure into a control current value of the solenoid proportional valve 140 corresponding to the demanded pilot pressure, and outputs a control current to the solenoid 146 of the solenoid proportional valve 140 to drive the solenoid proportional valve 140. The command pilot pressure generated at the solenoid proportional valve 140 increases as the control current value increases. In the present embodiment, when the operation device 180 is operated by an operator in a state where the main pump 135 and the pilot pump 136 are being driven by the engine 191, the hydraulic actuator performs an action according to the operation direction and operation amount of the operation device 180.

The engine controller 190 adjusts the injection quantity of a fuel to be injected into cylinders of the engine 191 by using a fuel injection device, and controls the rotation speed of the engine 191. An engine control dial 198 as an engine revolution speed setting device for setting a target rotation speed of the engine 191 is connected to the machine body controller 120. The machine body controller 120 computes a target rotation speed of the engine 191 on the basis of an operation signal of the engine control dial 198 provided in the operation room 118, and outputs the target rotation speed to the engine controller 190.

The rotation speed sensor 192 that senses the rotation speed of the engine 191 is connected to the engine controller 190 through a signal line (not depicted). The engine controller 190 controls the fuel injection device such that the actual rotation speed of the engine 191 sensed at the rotation speed sensor 192 becomes the target rotation speed input from the machine body controller 120.

The operation controller 150 is connected with the ignition switch 188, and an operation position of the ignition switch 188 is sensed by the operation controller 150. The operation controller 150 controls the activation or stop of the machine body controller 120 and the engine controller 190 on the basis of the operation position of the ignition switch 188. In addition, the operation controller 150 controls the activation or stop of the engine 191 on the basis of the operation position of the ignition switch 188.

The ignition switch 188 enables OFF operation for interrupting the supply of electric power from the battery 197 (see FIG. 1) to the engine controller 190, ON operation for supplying electric power from the battery 197 to the engine controller 190, and start operation (activation operation) for driving the engine 191 by using the starter motor 196. The ON operation is operation for supplying electric power to the engine controller 190 which is a premise of the activation of the engine 191, and is one type of operation for activating the engine 191. The ignition switch 188 according to the present embodiment is an engine key switch at which pivoting operation of an engine key to each operation position is enabled through insertion of the engine key into the key hole of a key cylinder.

The operation controller 150 and the battery 197 are connected to each other by a normally-closed relay which is normally closed. The operation controller 150 is connected with a starter relay 193, an ACC relay 194, and an IG relay 195.

The ignition switch 188 has four operation positions, which are an OFF position (stop position), an ACC position, an ON position (operation position), and a start position (activation position). The operation controller 150 controls opening and closing of the various types of relay 193, 194, and 195 depending on the operation position of the ignition switch 188.

The starter relay 193 is a relay for supplying or interrupting electric power from the battery 197 with respect to the starter motor 196 that activates the engine 191. When the starter relay 193 is turned on, that is, when the starter relay 193 gets closed, electric power is supplied from the battery 197 to the starter motor 196, the starter motor 196 starts operation to drive the engine 191. That is, cranking of the engine 191 by the starter motor 196 is performed. When the starter relay 193 is turned off, that is, when the starter relay 193 gets opened, the supply of electric power from the battery 197 to the starter motor 196 is interrupted.

The ACC relay 194 is a relay for supplying or interrupting electric power from the battery 197 with respect to accessory (ACC) devices such as a radio (not depicted), audio equipment (not depicted), the display device 115, or an accessory controller (not depicted) that controls those devices. When the ACC relay 194 is turned on, that is, when the ACC relay 194 gets closed, electric power is supplied from the battery 197 to the accessory devices. When the ACC relay 194 is turned off, that is, when the ACC relay 194 gets opened, the supply of electric power from the battery 197 to the accessory devices is interrupted.

The IG relay 195 is a relay for supplying or interrupting electric power from the battery 197 with respect to ignition (IG) devices such as an air conditioner (not depicted), the machine body controller 120, or the engine controller 190. When the IG relay 195 is turned on, that is, when the IG relay 195 gets closed, electric power is supplied from the battery 197 to the ignition devices. When the IG relay 195 is turned off, that is, when the IG relay 195 gets opened, the supply of electric power from the battery 197 to the ignition devices is interrupted.

Meanwhile, foreign matters such as metal pieces or dust are included in the hydraulic working fluid in the hydraulic system 106 depicted in FIG. 2. Although a filter (not depicted) is provided to the hydraulic system 106 in order to remove foreign matters, foreign matters which are smaller than the opening area of the filter cannot be removed with the filter, and flow into each piece of hydraulic equipment of the hydraulic system 106. If a phenomenon (silting) in which the foreign matters flow into the solenoid proportional valve 140, and the foreign matters are accumulated in the space between the spool 142 and the sleeve 143 occurs, a sticking phenomenon (valve stick) in which actions of the spool 142 are limited by the foreign matters occurs in some cases.

In view of this, the operation controller 150 according to the present embodiment drives the solenoid proportional valve 140 while the engine 191 is in a stopped state before the activation thereof when the ON operation for activating the hydraulic excavator 100 is performed as operation for activating the engine 191, thereby preventing accumulation of foreign matters in the solenoid proportional valve 140 without influencing body behavior. Hereinbelow, functions of control (hereinafter, written also as sticking preventing control) for preventing the sticking phenomenon of the solenoid proportional valve 140 performed by the operation controller 150 are explained in detail.

FIG. 4 is a functional block diagram of the operation controller 150 according to the first embodiment. As depicted in FIG. 4, the operation controller 150 functions as an engine state assessing section 161, a switch operation assessing section 162, a current application condition assessing section 163, a solenoid valve control section 164, and a relay control section 165 by executing programs stored in the non-volatile memory 153.

The engine state assessing section 161 assesses, on the basis of a sensing result of the rotation speed sensor 192, whether the engine 191 is in a stopped state or in an operation state. Where a rotation speed N of the engine 191 sensed at the rotation speed sensor 192 is equal to or lower than a speed threshold NO, the engine state assessing section 161 assesses that the engine 191 is in a stopped state. Where the rotation speed N of the engine 191 sensed at the rotation speed sensor 192 is equal to or higher than a speed threshold Ni, the engine state assessing section 161 assesses that the engine 191 is in an operation state.

The speed threshold NO is a threshold for assessing whether or not the engine 191 is in a stopped state, and is stored in the non-volatile memory 153 (see FIG. 3) of the operation controller 150 in advance. For example, the speed threshold NO is a value lower than the minimum rotation speed that can be set with the engine control dial 198 (see FIG. 2), and is set to a value equal to or greater than 0 (zero) (e.g. 0 to several rpm).

The speed threshold Ni is a threshold for assessing whether or not the engine 191 is in an operation state, and is stored in the non-volatile memory 153 (see FIG. 3) of the operation controller 150 in advance. In the present embodiment, that the engine 191 is in an operation state means a state where the activation of the engine 191 by cranking of the starter motor 196 has been completed, and the operation of the engine 191 is controlled by the engine controller 190. For example, the speed threshold Ni is a value equal to or lower than the minimum rotation speed that can be set with the engine control dial 198 (see FIG. 2), and is set to a value greater than the maximum cranking speed of the starter motor 196.

The switch operation assessing section 162 assesses whether the ignition switch 188 has been operated to any one of the OFF position, the ACC position, the ON position, and the start position. Note that operating the ignition switch 188 to the OFF position is equivalent to performing the OFF operation by using the ignition switch 188. Operating the ignition switch 188 to the ACC position is equivalent to performing the ACC operation by using the ignition switch 188. Although operating the ignition switch 188 to the ON position is equivalent to performing the ON operation by using the ignition switch 188, the ON position has two patterns. In one pattern, the ignition switch 188 is operated to the ON position after being operated to the start position mentioned later (after cranking operation is performed), and in the other pattern, the ignition switch 188 is operated to the ON position without being operated to the start position. Operating the ignition switch 188 to the start position is equivalent to performing the start operation (activation operation) by using the ignition switch 188. That is, the switch operation assessing section 162 assesses whether or not the OFF operation has been performed, whether or not the ACC operation has been performed, whether or not the ON operation has been, and whether or not the start operation has been performed by the ignition switch 188.

The relay control section 165 outputs a command for turning on the ACC relay 194 to the ACC relay 194 when the switch operation assessing section 162 assesses that the operation position of the ignition switch 188 is at the ACC position. When the switch operation assessing section 162 assesses that the operation position of the ignition switch 188 is at the ON position, the relay control section 165 outputs a command for turning on the IG relay 195 to the IG relay 195.

The relay control section 165 outputs a command for turning on the starter relay 193 to the starter relay 193 when the switch operation assessing section 162 assesses that the operation position of the ignition switch 188 is at the start position. The command for turning on the starter relay 193 is output also to the engine controller 190, and activation control of the engine 191 using the fuel injection device is started by the engine controller 190.

The relay control section 165 outputs a command for turning off the starter relay 193 to the starter relay 193 when the switch operation assessing section 162 assesses that the operation position of the ignition switch 188 is at the ON position. When the switch operation assessing section 162 assesses that the operation position of the ignition switch 188 is at the ACC position, the relay control section 165 outputs a command for turning off the IG relay 195 to the IG relay 195. When the switch operation assessing section 162 assesses that the operation position of the ignition switch 188 is at the OFF position, the relay control section 165 outputs a command for turning off the ACC relay 194 to the ACC relay 194.

Note that although not depicted, when the switch operation assessing section 162 assesses that the operation position of the ignition switch 188 has been operated from the ON position to the ACC position when the engine 191 is in an operation state, the relay control section 165 outputs an engine stop command to the engine controller 190. Thus, control of the engine 191 using the fuel injection device by the engine controller 190 ends, and the engine 191 stops.

The current application condition assessing section 163 assesses whether or not a current application condition is established when a current application flag mentioned later has been turned off. The current application condition is established when both of the following condition 1 and condition 2 are satisfied, and is not established when at least any one of the condition 1 and the condition 2 is not satisfied.

(Condition 1) The ON operation to the ON position is performed by the ignition switch 188 without being operated to the start position.

(Condition 2) The engine 191 is in a stopped state.

In the present embodiment, the condition 1 is satisfied when the operation position of the ignition switch 188 is operated to the ON position, and the condition 2 is satisfied when the rotation speed of the engine 191 is equal to or lower than the speed threshold NO.

The current application condition assessing section 163 assesses that the current application condition is established when the engine state assessing section 161 assesses that the engine 191 is in a stopped state, and additionally the switch operation assessing section 162 assesses that the operation position of the ignition switch 188 has been operated to the ON position. The current application condition assessing section 163, when assessing that the current application condition is established, turns on the current application flag.

The current application condition assessing section 163 assesses that the current application condition is not established when the engine state assessing section 161 assesses that the engine 191 is not in a stopped state. In addition, when the switch operation assessing section 162 assesses that the operation position of the ignition switch 188 has been operated to an operation position other than the ON position, the current application condition assessing section 163 assesses that the current application condition is not established. The current application condition assessing section 163, when assessing that the current application condition is not established, keeps the current application flag turned off.

The current application condition assessing section 163 assesses whether or not a current application cancel condition is established when the current application flag has been turned on. When the engine state assessing section 161 assesses that the engine 191 is in an operation state, the current application condition assessing section 163 assesses that the current application cancel condition is established. When the switch operation assessing section 162 assesses that the operation position of the ignition switch 188 has been operated to the ACC position or to the OFF position, the current application condition assessing section 163 assesses that the current application cancel condition is established. The current application condition assessing section 163, when assessing that the current application cancel condition is established, turns off the current application flag.

The current application condition assessing section 163 assesses that the current application cancel condition is not established when the engine state assessing section 161 assesses that the engine 191 is not in an operation state, and additionally the switch operation assessing section 162 assesses that the operation position of the ignition switch 188 has been operated to the ON position or to the start position. The current application condition assessing section 163, when assessing that the current application cancel condition is not established, keeps the current application flag turned on.

The solenoid valve control section 164 applies a drive current to the solenoid proportional valve 140 to drive the solenoid proportional valve 140 when the current application flag having been turned off is turned on. Applying a drive current to the solenoid proportional valve 140 means supplying, to the solenoid proportional valve 140, a control current I necessary for driving the spool 142 (i.e. for moving the spool 142 from the fully-closed position).

In the present embodiment, the solenoid valve control section 164 applies a drive current to the solenoid proportional valve 140 for a predetermined length of time t0 set in advance to move the spool 142 to the full stroke position (fully-opened position), and keeps the spool 142 at the full stroke position. The solenoid valve control section 164 stops the application of the drive current to the solenoid proportional valve 140 after a lapse of the predetermined length of time t0. Note that measurement of time is performed by a timer function of the operation controller 150.

The solenoid valve control section 164 outputs, as the drive current, a maximum current Imax for moving the spool 142 of the solenoid proportional valve 140 from the fully-closed position to the fully-opened position, to the solenoid 146 of the solenoid proportional valve 140. The predetermined length of time t0 is set in advance to a value of approximately 200 msec to 300 msec.

The solenoid valve control section 164 stops the application of the drive current to the solenoid proportional valve 140 when the current application flag having been turned on is turned off. Stopping the application of the drive current to the solenoid proportional valve 140 means making the control current I being supplied to the solenoid proportional valve 140 a minimum current Imin. The minimum current Imin is equivalent to a waiting current that can keep the spool 142 at the fully-closed position.

A specific example of sticking preventing control of the solenoid proportional valve 140 that is performed when the engine 191 is activated in the hydraulic excavator 100 according to the present embodiment is explained below along with operation of the ignition switch 188 by an operator, with reference to FIG. 5 and FIG. 6A.

FIG. 5 is a table representing the relationship among states of the engine 191, operation positions of the ignition switch 188, and ON/OFF states of the current application flag. FIG. 6A is a time chart of a control current supplied from the operation controller 150 according to the first embodiment to the solenoid 146 of the solenoid proportional valve 140. In FIG. 6A, the horizontal axis represents elapsed time t, and the vertical axis represents the magnitude of the control current I supplied to the solenoid proportional valve 140.

When the operator gets in the operation room 118, and operates the ignition switch 188 from the OFF position to the ACC position, electric power is supplied to the ACC devices. Thus, the state of the hydraulic excavator 100 transitions from the state of No. 1 to the state of No. 2 in FIG. 5. In the states of No. 1 and No. 2, the current application flag is turned off.

When the operator operates the ignition switch 188 from the ACC position to the ON position as preparatory operation for activating the engine 191, electric power is supplied to the IG devices including the engine controller 190. Thus, the state of the hydraulic excavator 100 transitions from the state of No. 2 to the state of No. 3 in FIG. 5, and the current application condition is established. As a result, the current application flag is turned on.

Figure 6A:
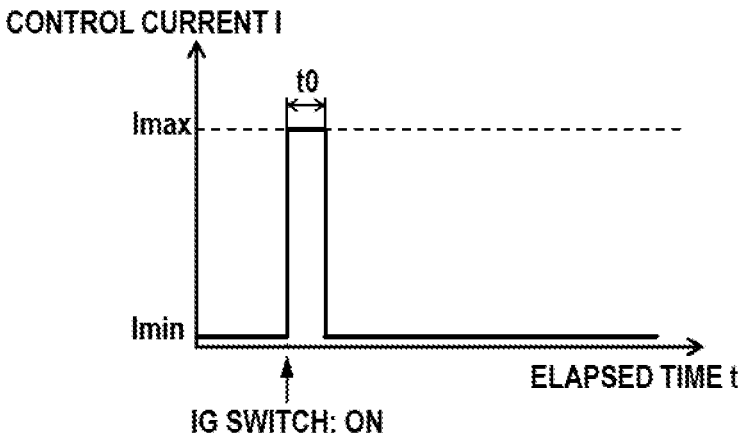
FIG. 6A is a time chart of a control current supplied from the operation controller according to the first embodiment to a solenoid of a solenoid proportional valve.

As depicted in FIG. 6A, when the current application flag is turned on, the operation controller 150 changes the control current I supplied to the solenoid 146 of the solenoid proportional valve 140 from the minimum current Imin to the maximum current Imax. Thus, the spool 142 of the solenoid proportional valve 140 moves from the fully-closed position to the fully-opened position. Since the spool 142 of the solenoid proportional valve 140 can be stroked fully from one end to the other end, foreign matters in the solenoid proportional valve 140 can be removed effectively. At this time, the engine 191 is in a stopped state, and the pilot pump 136 also is stopped. Because of this, the directional control valve 130 does not perform an action even if the solenoid proportional valve 140 is driven.

After a lapse of the predetermined length of time t0 since the current application flag has been turned on, the operation controller 150 changes the control current I supplied to the solenoid 146 of the solenoid proportional valve 140 from the maximum current Imax to the minimum current Imin. Thus, the spool 142 of the solenoid proportional valve 140 moves from the fully-opened position to the fully-closed position.

When the operator operates the ignition switch 188 from the ON position to the start position, the starter motor 196 is driven, and also activation control of the engine 191 by the engine controller 190 is performed. Note that since the state of the hydraulic excavator 100 is the state of No. 4 in FIG. 5 during cranking until the engine 191 activated, the current application flag is kept turned on.

Completion of the activation of the engine 191 after the ignition switch 188 has been operated to the start position takes approximately several seconds. In contrast to this, the application time (predetermined length of time) t0 of the drive current to the solenoid proportional valve 140 is approximately 200 to 300 msec. Because of this, even where the length of time during which the ignition switch 188 is operated to the ON position is short when the operator operates the ignition switch 188 from the ACC position through the ON position to the start position, the spool 142 of the solenoid proportional valve 140 can be stroked fully.

After compression of the activation of the engine 191 by cranking and engine activation control by the engine controller 190, the state of the hydraulic excavator 100 transitions from the state of No. 4 to the state of No. 5 in FIG. 5, and the current application cancel condition is established. As a result, the current application flag is turned off.

The operator, when determining that the activation of the engine 191 is completed, returns the ignition switch 188 from the start position to the ON position. Note that by releasing the ignition switch 188 from the hand, the ignition switch 188 returns from the start position to the ON position due to an urging force produced by a spring (not depicted), and is kept at the ON position. Thus, the state of the hydraulic excavator 100 transitions from the state of No. 5 to the state of No. 6 in FIG. 5.

By operating the operation device 180, the operator moves the work implement 104, the swing structure 103, and the travel structure 102, and performs work such as excavation work or loading work. After ending the work, the operator operates the ignition switch 188 to the OFF position. Since the ignition switch 188 is operated through the ACC position to the OFF position, the operation controller 150 outputs the engine stop command to the engine controller 190. Thus, the engine 191 stops, and the state of the hydraulic excavator 100 returns from the state of No. 6 through the state of No. 2 to the state of No. 1 in FIG. 5.

According to the embodiment mentioned above, the following actions and effects are attained.

(1) The hydraulic excavator (work machine) 100 according to the present embodiment includes: the engine 191; the main pump (first pump) 135 and the pilot pump (second pump) 136 that are driven by the engine 191; the hydraulic actuator (the hydraulic cylinder 110, etc.) driven by the hydraulic working fluid supplied from the main pump 135; the directional control valve (control valve) 130 that controls a flow of the hydraulic working fluid supplied from the main pump 135 to the hydraulic actuator (the hydraulic cylinder 110, etc.); the solenoid proportional valve (solenoid valve) 140 that reduces the pressure of the hydraulic working fluid supplied from the pilot pump 136 to generate the pilot pressure for operating the directional control valve 130; the operation controller (controller) 150 that controls the solenoid proportional valve 140; the ignition switch (engine operating section) 188 that enables operation for activating the engine 191; and the rotation speed sensor 192 that senses the rotation speed of the engine 191.

The operation controller 150 assesses whether or not the current application condition including that it is assessed on the basis of a sensing result of the rotation speed sensor 192 that the engine 191 is in a stopped state, and including that the ON operation of the ignition switch 188 is performed in a state where the activation operation is not performed by the ignition switch 188 is established. The operation controller 150 applies a drive current to the solenoid proportional valve 140 to drive the solenoid proportional valve 140 when it is assessed that the current application condition is established.

According to this configuration, since the solenoid proportional valve 140 is driven when the engine 191 is in a stopped state, it is possible to prevent the hydraulic actuator (the hydraulic cylinder 110, etc.) from being actuated undesirably due to an action of the solenoid proportional valve 140. Accordingly, the movement amount of the spool (valve body) 142 of the solenoid proportional valve 140 can be increased. That is, according to the present embodiment, foreign matters in the solenoid proportional valve 140 can be removed effectively without influencing an action of the hydraulic actuator. As a result, malfunctions of the hydraulic actuator caused by biting of the foreign matters by the solenoid proportional valve 140 can be prevented.

(2) The operation controller 150 stops application of a drive current to the solenoid proportional valve 140 when it is assessed that the engine 191 is in an operation state in a state where it is assessed that the current application condition is established, and the drive current is being applied to the solenoid proportional valve 140. According to this configuration, even where the engine 191 is activated by some possibility during application of a drive current to the solenoid proportional valve 140 in the sticking preventing control, the application of the drive current to the solenoid proportional valve 140 stops. Accordingly, malfunctions of the hydraulic actuator caused by the sticking preventing control can be prevented.

(3) The solenoid proportional valve 140 has the spool (valve body) 142 that is stroked between the fully-closed position and the fully-opened position, and the operation controller 150 applies a drive current to the solenoid proportional valve 140 for the predetermined length of time t0 set in advance to move the spool 142 to the full stroke position (fully-opened position) and keeps the spool 142 at the full stroke position when it is assessed that the current application condition is established. According to this configuration, foreign matters can be removed effectively as compared with a case where the spool 142 is moved to a position such as an intermediate position between the fully-closed position and the fully-opened position by application of a drive current to the solenoid proportional valve 140.

As mentioned above, the present embodiment can provide the hydraulic excavator 100 that can remove foreign matters in the solenoid proportional valve 140 more effectively without influencing an action of the hydraulic actuator.

First Modification Example of First Embodiment

Whereas the operation controller 150 applies a drive current to the solenoid proportional valve 140 only once when it is assessed that the current application condition is established in the example explained in the first embodiment, the present invention is not limited to this. The operation controller 150 may apply a drive current to the solenoid proportional valve 140 repeatedly multiple times when it is assessed that the current application condition is established.

Figure 6B:
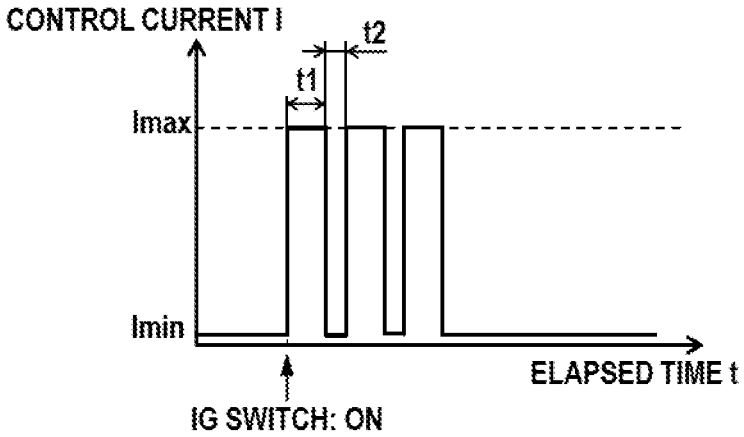
FIG. 6B is a time chart of the control current supplied from the operation controller according to a first modification example of the first embodiment to the solenoid of the solenoid proportional valve.

FIG. 6B is a figure similar to FIG. 6A, and is a time chart of the control current supplied from the operation controller 150 according to a first modification example of the first embodiment to the solenoid 146 of the solenoid proportional valve 140. As depicted in FIG. 6B, when the current application flag having been turned off is turned on, the solenoid valve control section 164 execute multiple cycles (three cycles in the present modification example) of an application process including application and stop of a drive current. In one cycle of the application process, the solenoid valve control section 164 outputs the maximum current Imax to the solenoid proportional valve 140 for a first length of time t1 set in advance, and thereafter outputs the minimum current Imin to the solenoid proportional valve 140 for a second length of time t2 set in advance.

According to such a modification example, since foreign matters can be removed effectively as compared with the case where the solenoid proportional valve 140 is driven only once, the frequency of occurrence of the sticking phenomenon of the solenoid proportional valve 140 can be reduced.

Second Modification Example of First Embodiment

Whereas the operation controller 150 outputs the maximum current Imax to the solenoid proportional valve 140 immediately when it is assessed that the current application condition is established in the example explained in the first embodiment, the present invention is not limited to this. The operation controller 150 may increase the magnitude of the control current I gradually along with a lapse of time when it is assessed that the current application condition is established.

Figure 6C:
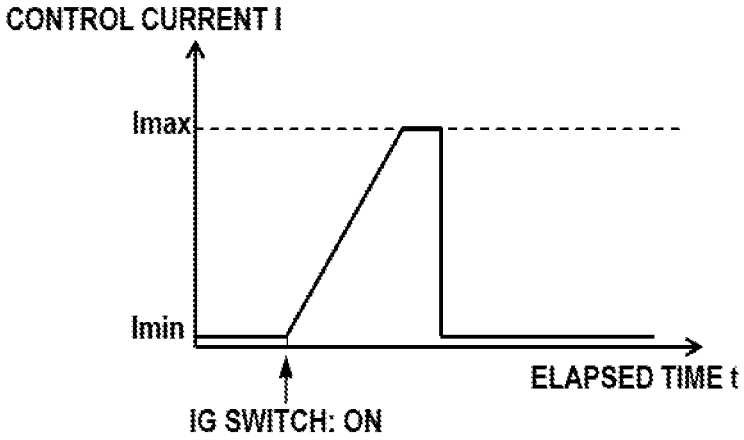
FIG. 6C is a time chart of the control current supplied from the operation controller according to a second modification example of the first embodiment to the solenoid of the solenoid proportional valve.

FIG. 6C is a figure similar to FIG. 6A, and is a time chart of the control current supplied from the operation controller 150 according to a second modification example of the first embodiment to the solenoid 146 of the solenoid proportional valve 140. As depicted in FIG. 6C, the solenoid valve control section 164 gradually increases the control current I from the minimum current Imin to the maximum current Imax along with a lapse of time when the current application flag having been turned off is turned on. According to such a modification example, foreign matters can be removed effectively in some cases than in the control method explained in the first embodiment, depending on the state of foreign matters that are present in the solenoid proportional valve 140.

Third Modification Example of First Embodiment

Whereas the current application condition assessing section 163 assesses that the current application condition is established when both the condition 1 and the condition 2 are satisfied in the example explained in the first embodiment, the present invention is not limited to this. It is sufficient if the current application condition includes at least that the ON operation is performed by the ignition switch 188, and that the engine 191 is in a stopped state.

In the present modification example, the current application condition is established when all of the condition 1 and condition 2 mentioned above and the following condition 3 are satisfied, and is not established when at least any one of the condition 1, the condition 2, and the condition 3 is not satisfied.

(Condition 3) That the operation device 180 is being operated.

The condition 3 is satisfied when a lever operation amount L of the operation device 180 is equal to or greater than an operation amount threshold LO.

The operation amount threshold LO is a threshold for assessing whether or not the operation device 180 is being operated, and is stored in the non-volatile memory 153 of the operation controller 150 in advance. When it is assessed that the current application condition is established, the solenoid valve control section 164 turns on the current application flag.

In such a modification example, when the operator operates the ignition switch 188 from the OFF position to the ON position, and further operates the operation device 180, the solenoid proportional valve 140 is driven. Accordingly, even where the ignition switch 188 is operated from the OFF position to the ON position, it is also possible not to drive the solenoid proportional valve 140 by not operating the operation device 180.

Note that in the present modification example, the operation controller 150 may drive all solenoid proportional valves 140 corresponding to a plurality of hydraulic actuators when the predetermined operation device 180 is operated or may drive only a solenoid proportional valve 140 corresponding to the operation direction of each operation device 180.

Second Embodiment

The hydraulic excavator 100 according to the second embodiment is explained with reference to FIG. 7 and FIG.

8. Note that constituent elements identical to or equivalent to constituent elements explained in the first embodiment are given identical reference numerals, and differences are explained mainly. An operation controller 250 according to the second embodiment applies a drive current according to the operation amount of the operation device 180 to the solenoid proportional valve 140 when it is assessed that the current application condition is established. Hereinbelow, functions of the operation controller 250 according to the second embodiment are explained in detail.

Figure 7:
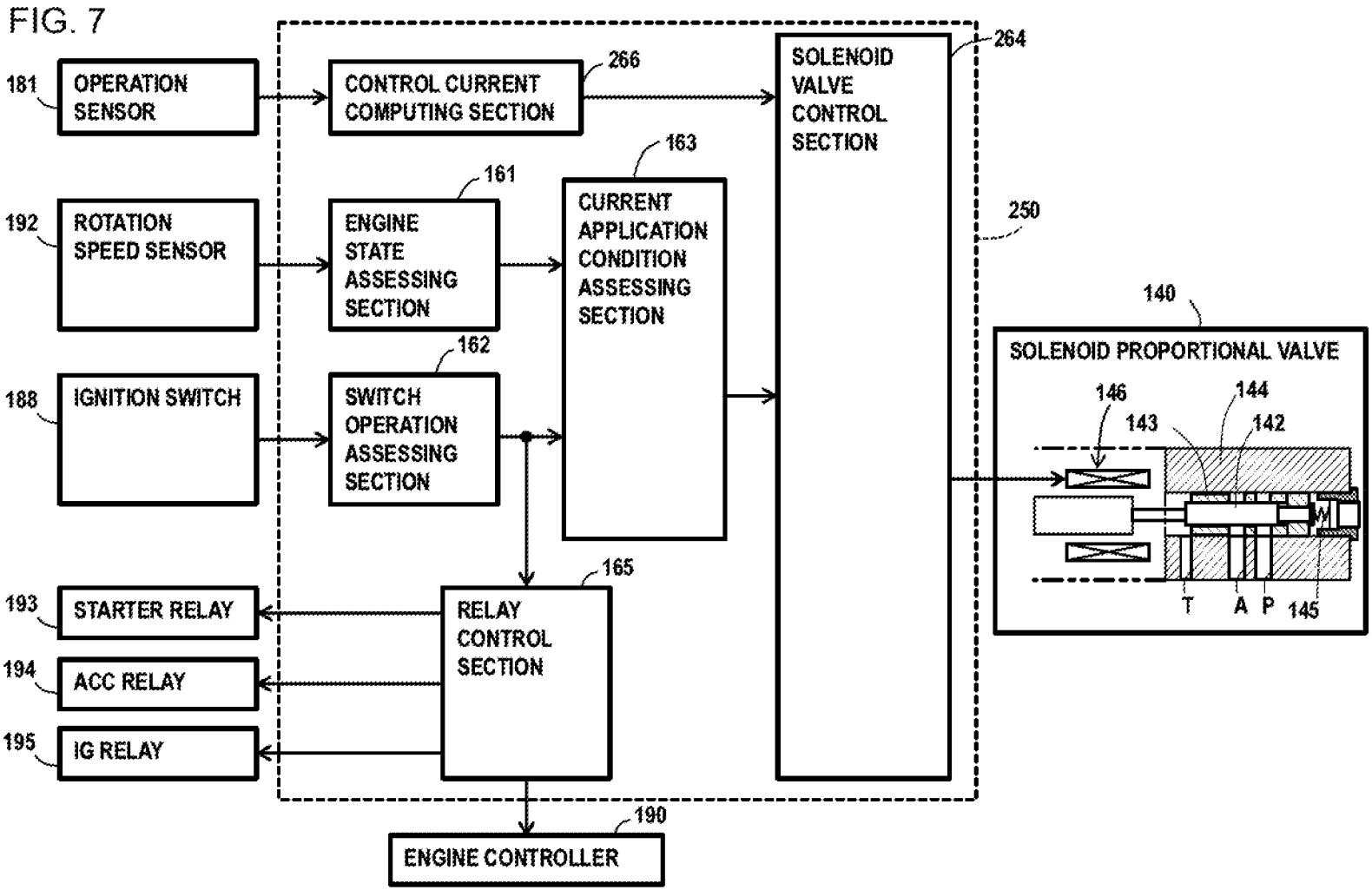
FIG. 7 is a functional block diagram of an operation controller according to a second embodiment.

FIG. 7 is a functional block diagram of the operation controller 250 according to the second embodiment. As depicted in FIG. 7, the operation controller 250 functions as the engine state assessing section 161, the switch operation assessing section 162, the current application condition assessing section 163, a solenoid valve control section 264, the relay control section 165, and a control current computing section 266 by executing programs stored in the non-volatile memory 153.

Figure 8:
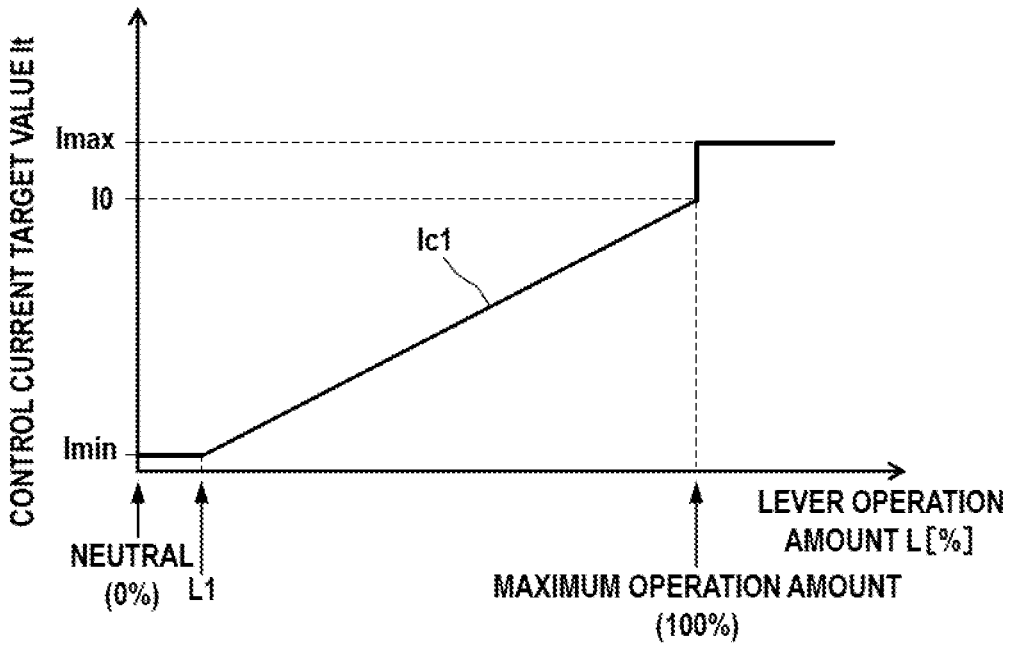
FIG. 8 is a figure depicting control current characteristics Ic1.

The control current computing section 266 converts an operation signal from the operation sensor 181 into the lever operation amount L. For example, the lever operation amount L is represented by a value that is assumed to be 0 [%] when the operation lever 182 is at the neutral position, and is assumed to be 100 [%] when the operation lever 182 is at a full lever position (maximum operation). The control current computing section 266 refers to control current characteristics Ic (see FIG. 8) stored in the non-volatile memory 153, and computes a control current target value It on the basis of the lever operation amount L sensed at the operation sensor 181. FIG. 8 is a figure depicting control current characteristics Ic1. The control current characteristics Ic1 depicted in FIG. 8 are stored in a table format on the non-volatile memory 153.

The relationship between the lever operation amount L and the control current target value It specified by the control current characteristics Ic1 is as follows. In the range of the lever operation amount L from 0 [%] to equal to or lower than a predetermined operation amount Li, the control current target value It is the minimum current Imin. In the range of the lever operation amount L which is greater than the predetermined operation amount Li and smaller than the maximum operation amount, the control current target value It increases until a predetermined current I0 is reached in proportion to an increase in the lever operation amount L. When the lever operation amount L is 100 [%], which is the maximum operation amount, the control current target value It is the maximum current Imax.

The solenoid valve control section 264 depicted in FIG. 7 applies the control current I, which is equal to the target value It computed at the control current computing section 266, to the solenoid proportional valve 140 when the current application flag having been turned off is turned on.

Note that similarly to the first embodiment, when the engine state assessing section 161 assesses that the engine 191 is in a stopped state, and additionally the switch operation assessing section 162 assesses that the operation position of the ignition switch 188 has been operated to the ON position, the current application condition assessing section 163 assesses that the current application condition is established.

In such a second embodiment, when the operator operates the ignition switch 188 from the OFF position to the ON position, and further operates the operation device 180, the solenoid proportional valve 140 is driven. The spool 142 of the solenoid proportional valve 140 performs an action according to the operation amount of the operation device 180. Because of this, for example, when the operator repeatedly executes an action of operating the operation lever 182 of the operation device 180 from the neutral position to the maximum operation amount, and then returning the operation lever 182 to the neutral position, the spool 142 of the solenoid proportional valve 140 repeatedly reciprocates between the fully-closed position and the fully-opened position. In addition, when the operator gradually inclines the operation lever 182 of the operation device 180 from the neutral position to the maximum operation amount, the spool 142 of the solenoid proportional valve 140 gradually moves from the fully-closed position toward the fully-opened position.

In this manner, the operation controller 250 according to the present second embodiment applies a drive current according to the operation amount of the operation device 180 to the solenoid proportional valve 140 when it is assessed that the current application condition is established. Accordingly, according to the present second embodiment, it is possible to cause the spool 142 of the solenoid proportional valve 140 to perform an action in accordance with operation of the operation device 180. Since it is possible to move the spool 142 of the solenoid proportional valve 140 in various manners, foreign matters can be removed more efficiently.

Note that in the present second embodiment, the operation controller 250 may drive all solenoid proportional valves 140 corresponding to a plurality of hydraulic actuators or may drive only a solenoid proportional valve 140 corresponding to the operation direction of each operation device 180 when the predetermined operation device 180 is operated.

Third Embodiment

The hydraulic excavator 100 according to a third embodiment is explained with reference to FIG. 9 and FIG. 10. Note that constituent elements identical to or equivalent to constituent elements explained in the first embodiment are given identical reference numerals, and differences are explained mainly. An operation controller 350 according to the third embodiment increases a drive current to be applied to the solenoid proportional valve 140 as the hydraulic working fluid temperature sensed at the temperature sensor 189 lowers. Hereinbelow, functions of the operation controller 350 according to the third embodiment are explained in detail.

Figure 9:
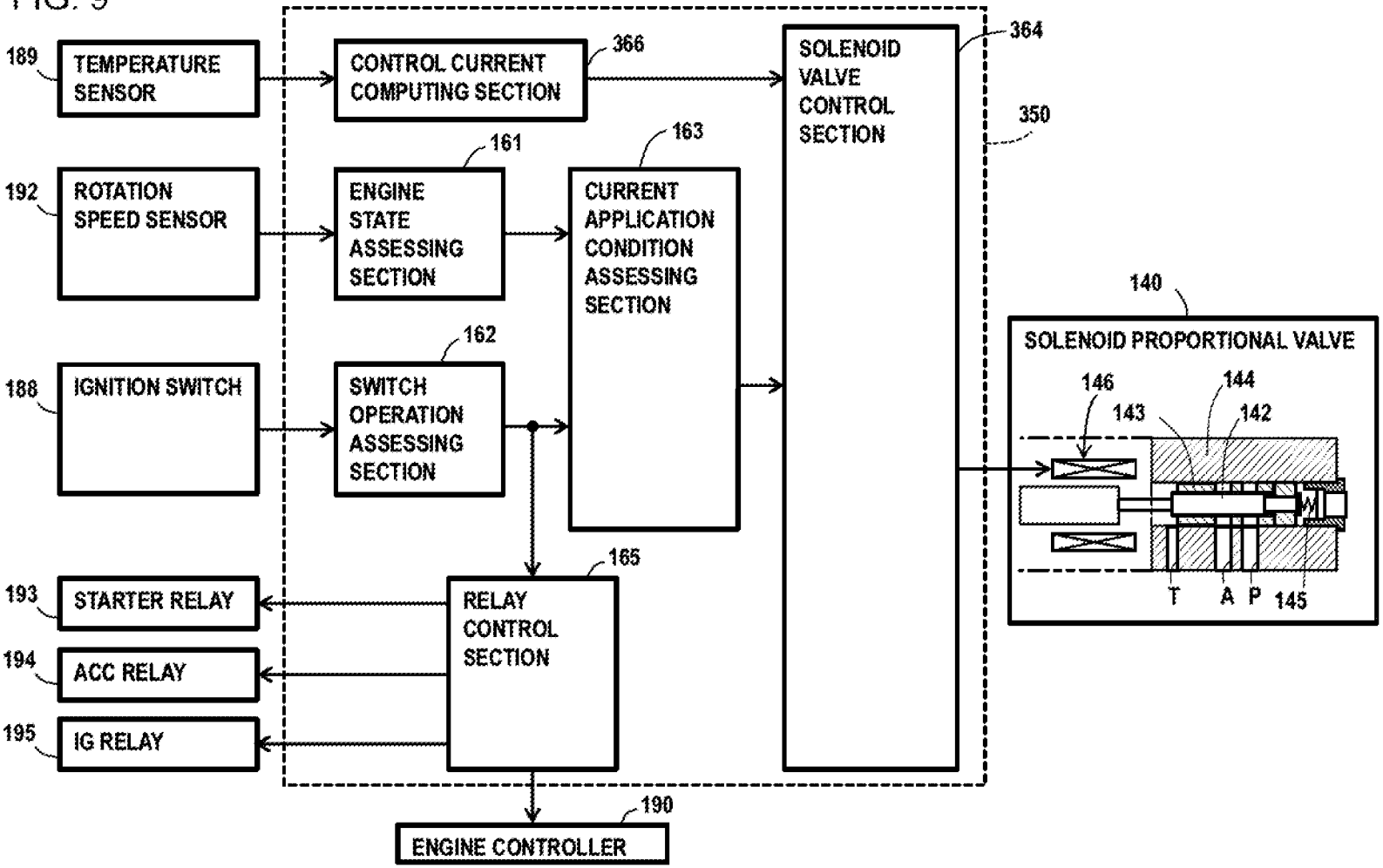
FIG. 9 is a functional block diagram of an operation controller according to a third embodiment.
Figure 10:
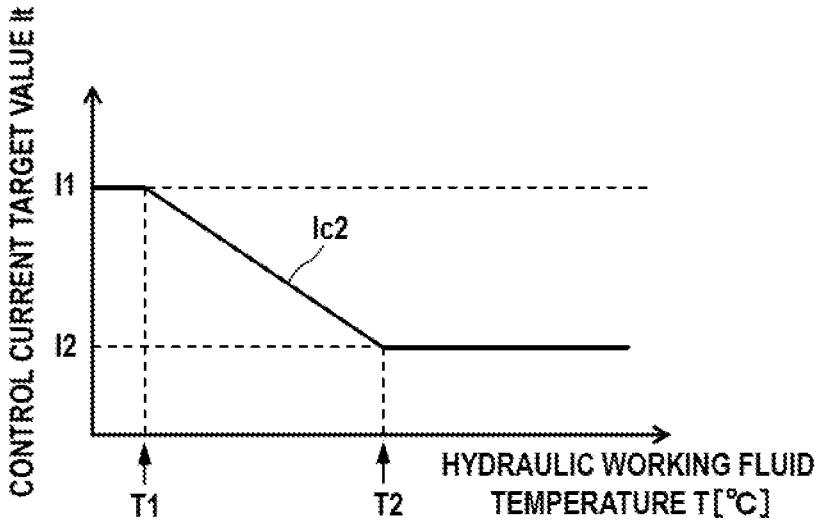
FIG. 10 is a figure depicting control current characteristics Ic2.

FIG. 9 is a functional block diagram of the operation controller 350 according to the third embodiment. As depicted in FIG. 9, the operation controller 350 functions as the engine state assessing section 161, the switch operation assessing section 162, the current application condition assessing section 163, a solenoid valve control section 364, the relay control section 165, and a control current computing section 366 by executing programs stored in the non-volatile memory 153.

The control current computing section 366 refers to control current characteristics Ic2 (see FIG. 10) stored in the non-volatile memory 153, and computes the control current target value It on the basis of a hydraulic working fluid temperature T sensed at the temperature sensor 189. FIG. 10 is a figure depicting the control current characteristics Ic2. The control current characteristics Ic2 depicted in FIG. 10 are stored in a table format in the non-volatile memory 153.

The relationship between the hydraulic working fluid temperature T and the control current target value It specified by the control current characteristics Ic2 is as follows.

In the range of the hydraulic working fluid temperature T which is equal to or lower than a first temperature T1, the control current target value It is a first current I1. In the range of the hydraulic working fluid temperature T which is higher than the first temperature T1 and lower than a second temperature T2, the control current target value It decreases in proportion to an increase in the hydraulic working fluid temperature T. In the range of the hydraulic working fluid temperature T which is equal to or higher than the second temperature T2, the control current target value It is a second current I2.

The magnitude relationship between the first temperature T1 and the second temperature T2 is T1<T2, and the magnitude relationship between the first current I1 and the second current I2 is I1>I2. For example, the first temperature T1 is approximately −20° C., and, for example, the second temperature T2 is approximately 20° C. The first current I1 is a current value that can move the spool 142 to the full stroke position when a drive current is to be applied for the predetermined length of time t0 and when the hydraulic working fluid temperature T is the first temperature T1. The second current I2 is a current value that can move the spool 142 to the full stroke position when a drive current is to be applied for the predetermined length of time t0 and when the hydraulic working fluid temperature T is the second temperature T2.

The solenoid valve control section 364 depicted in FIG. 9 applies the control current I, which is equal to the target value It computed at the control current computing section 366, to the solenoid proportional valve 140 for the predetermined length of time t0 when the current application flag having been turned off is turned on.

As the temperature T of the hydraulic working fluid lowers, the viscosity increases. As the viscosity of the hydraulic working fluid increases, force necessary for driving the spool 142 increases as compared to a case where the viscosity is low. Because of this, the operation controller 350 according to the present third embodiment increases a drive current to be applied to the solenoid proportional valve 140 as the hydraulic working fluid temperature T sensed at the temperature sensor 189 lowers. Thus, even where the hydraulic working fluid temperature T is low as in winter or the like, the solenoid proportional valve 140 can be moved from the fully-closed position to the fully-opened position. In addition, where the hydraulic working fluid temperature T is high as in summer or the like, deterioration of the charging rate of the battery 197 can be reduced by reducing a drive current to be supplied to the solenoid proportional valve 140.

Fourth Embodiment

The hydraulic excavator 100 according to a fourth embodiment is explained with reference to FIG. 11 and FIG. 12. Note that constituent elements identical to or equivalent to constituent elements explained in the first embodiment are given identical reference numerals, and differences are explained mainly. An operation controller 450 according to the fourth embodiment increases the length of time, during which a drive current is applied to the solenoid proportional valve 140, as the hydraulic working fluid temperature sensed at the temperature sensor 189 lowers. Hereinbelow, functions of the operation controller 450 according to the fourth embodiment are explained in detail.

Figure 11:
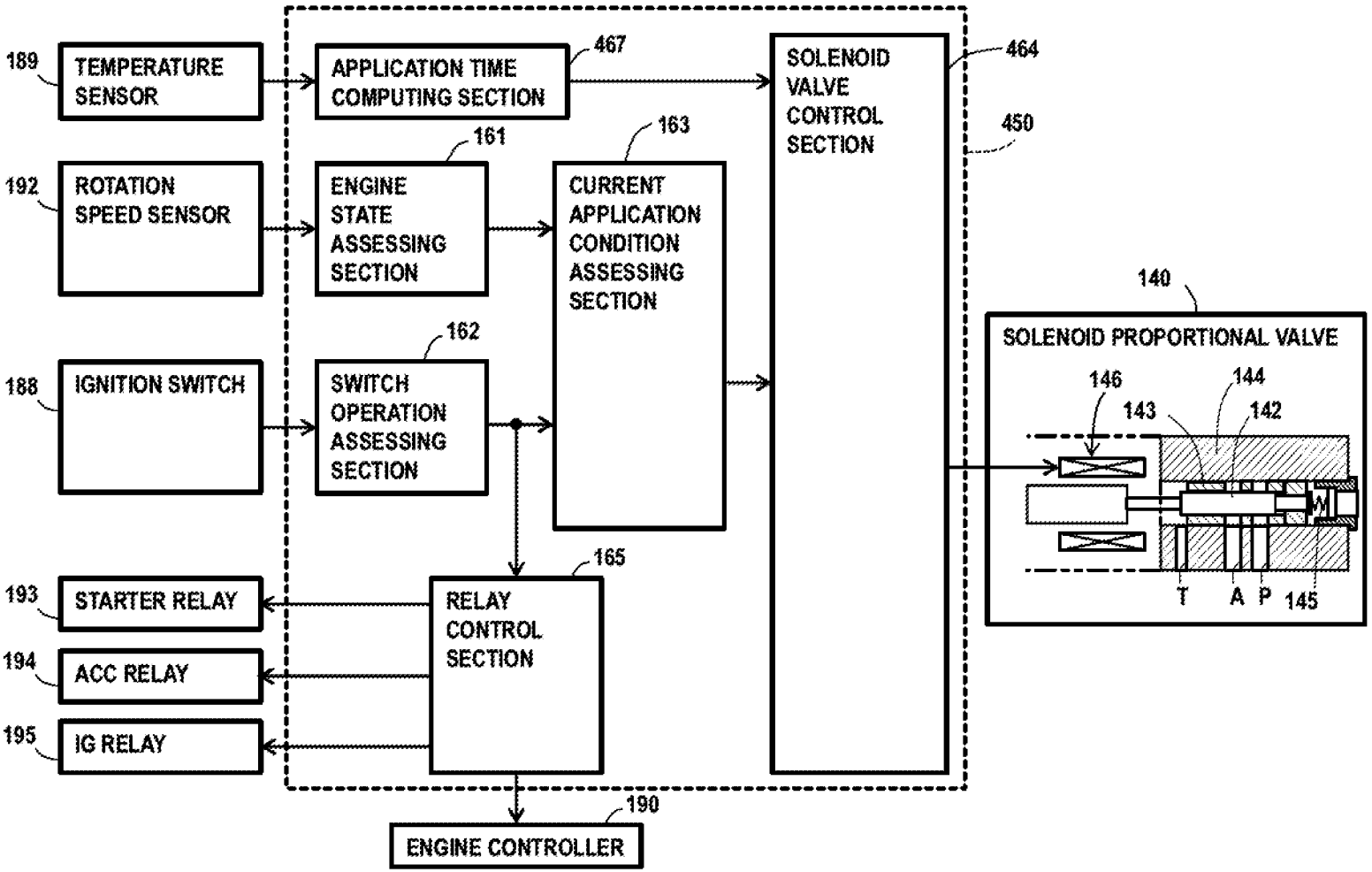
FIG. 11 is a functional block diagram of an operation controller according to a fourth embodiment.
Figure 12:
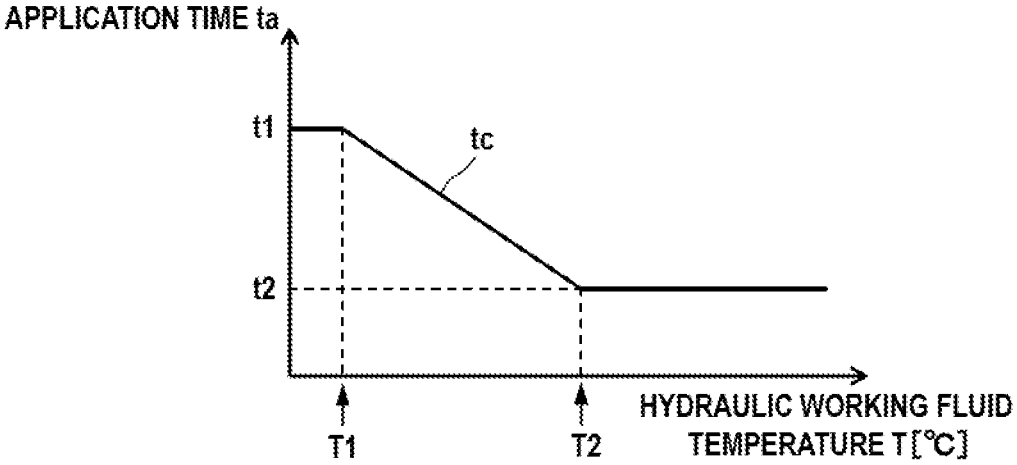
FIG. 12 is a figure depicting application time characteristics tc.

FIG. 11 is a functional block diagram of the operation controller 450 according to the fourth embodiment. As depicted in FIG. 11, the operation controller 450 functions as the engine state assessing section 161, the switch operation assessing section 162, the current application condition assessing section 163, a solenoid valve control section 464, the relay control section 165, and an application time computing section 467 by executing programs stored in the non-volatile memory 153.

The application time computing section 467 refers to application time characteristics tc (see FIG. 12) stored in the non-volatile memory 153, and computes application time ta on the basis of the hydraulic working fluid temperature T sensed at the temperature sensor 189. FIG. 12 is a figure depicting the application time characteristics tc. The application time characteristics tc depicted in FIG. 12 are stored in a table format in the non-volatile memory 153.

The relationship between the hydraulic working fluid temperature T and the application time ta specified by the application time characteristics tc is as follows. In the range of the hydraulic working fluid temperature T which is equal to or lower than the first temperature T1, the application time ta is the first length of time t1. In the range of the hydraulic working fluid temperature T which is higher than the first temperature T1 and lower than the second temperature T2, the application time ta decreases in proportion to an increase in the hydraulic working fluid temperature T. In the range of the hydraulic working fluid temperature T which is equal to or higher than the second temperature T2, the application time ta is the second length of time t2.

The magnitude relationship between the first temperature T1 and the second temperature T2 is T1<T2, and the magnitude relationship between the first length of time t1 and the second length of time t2 is t1>t2. For example, the first temperature T1 is approximately −20° C., and, for example, the second temperature T2 is approximately 20° C. The first length of time t1 is such application time that the spool 142 can be moved to the full stroke position when the maximum current Imax is applied to the solenoid proportional valve 140 and when the hydraulic working fluid temperature T is the first temperature T1. The second length of time t2 is such application time that the spool 142 can be moved to the full stroke position when the maximum current Imax is applied to the solenoid proportional valve 140 and when the hydraulic working fluid temperature T is the second temperature T2.

The solenoid valve control section 464 depicted in FIG. 11 applies the maximum current Imax to the solenoid proportional valve 140 for the application time ta computed at the application time computing section 467, when the current application flag having been turned off is turned on.

As explained in the third embodiment, as the temperature T of the hydraulic working fluid lowers, the viscosity increases. As the viscosity of the hydraulic working fluid increases, force necessary for driving the spool 142 increases as compared to a case where the viscosity is low. Because of this, the operation controller 450 according to the present fourth embodiment increases the length of time, during which a drive current is applied to the solenoid proportional valve 140, as the hydraulic working fluid temperature T sensed at the temperature sensor 189 lowers. Thus, even where the hydraulic working fluid temperature T is low as in winter or the like, the solenoid proportional valve 140 can be moved from the fully-closed position to the fully-opened position. In addition, where the hydraulic working fluid temperature T is high as in summer or the like, deterioration of the charging rate of the battery 197 can be reduced by reducing time during which a drive current is applied to the solenoid proportional valve 140.

Fifth Embodiment

The hydraulic excavator 100 according to a fifth embodiment is explained with reference to FIG. 13. Note that constituent elements identical to or equivalent to constituent elements explained in the first embodiment are given identical reference numerals, and differences are explained mainly. An operation controller 550 according to the fifth embodiment monitors whether or not an anomaly such as a disconnection or a short circuit has occurred in the solenoid proportional valve 140, and, when an anomaly has occurred, gives a notification to that effect to the operator. Hereinbelow, functions of the operation controller 550 according to the fifth embodiment are explained in detail.

Figure 13:
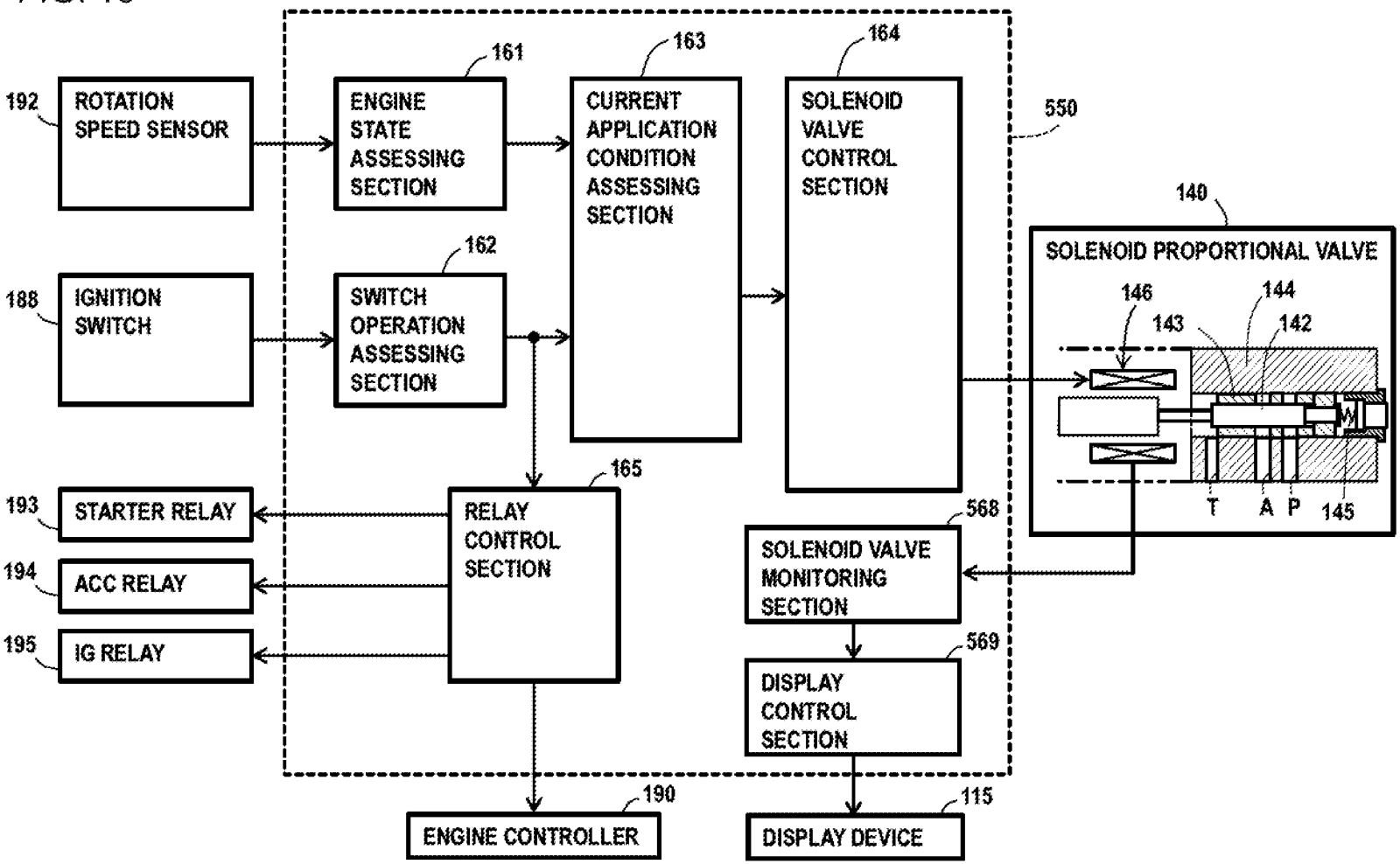
FIG. 13 is a functional block diagram of an operation controller according to a fifth embodiment.

FIG. 13 is a functional block diagram of the operation controller 550 according to the fifth embodiment. As depicted in FIG. 13, the operation controller 550 functions as the engine state assessing section 161, the switch operation assessing section 162, the current application condition assessing section 163, the solenoid valve control section 164, the relay control section 165, a solenoid valve monitoring section 568, and a display control section 569 by executing programs stored in the non-volatile memory 153.

The solenoid valve monitoring section 568 monitors feedback current from the solenoid proportional valve 140. Where the feedback value of the control current of the solenoid proportional valve 140 is smaller than a first current threshold, the solenoid valve monitoring section 568 assesses that a low current anomaly has occurred. Where the feedback value of the control current of the solenoid proportional valve 140 is equal to or greater than a second current threshold, the solenoid valve monitoring section 568 assesses that a high current anomaly has occurred. Where the feedback value of the control current of the solenoid proportional valve 140 is equal to or greater than the first current threshold and smaller than the second current threshold, the solenoid valve monitoring section 568 assesses that the solenoid proportional valve 140 is normal.

The first current threshold is a threshold for assessing whether or not a low current anomaly has occurred, and is stored in the non-volatile memory 153 of the operation controller 150 in advance. The second current threshold is a threshold for assessing whether or not a high current anomaly has occurred, and is stored in the non-volatile memory 153 of the operation controller 150 in advance.

The display control section 569 generates and outputs, when the solenoid valve monitoring section 568 assesses that a high current anomaly has occurred, to the display device 115, a first image such as an icon or a message representing that a high current anomaly has occurred, and that the sticking preventing control of the solenoid proportional valve 140 is not functioning normally. The display device 115 causes the display screen to display the first image, and notifies the operator that a high current anomaly has occurred, and the sticking preventing control of the solenoid proportional valve 140 is not functioning normally.

The display control section 569 generates and outputs, to the display device 115, a second image such as an icon or a message representing that a low current anomaly has occurred, and that the sticking preventing control of the solenoid proportional valve 140 is not functioning normally, when the solenoid valve monitoring section 568 assesses that a low current anomaly has occurred. The display device 115 causes the display screen to display the second image, and notifies the operator that a low current anomaly has occurred, and the sticking preventing control of the solenoid proportional valve 140 is not functioning normally.

Where the engine 191 of the hydraulic excavator 100 is left turned off for a long period, a sticking phenomenon occurs at a time of the activation of the engine 191 in some cases due to a lack of an oil film of the spool 142 of the solenoid proportional valve 140, degradation of the hydraulic working fluid, or the like. In this case, the feedback value of the control current becomes equal to or greater than the second threshold, and the solenoid valve monitoring section 568 assesses that a high current anomaly has occurred.

In this manner, the operation controller 550 according to the present fifth embodiment assesses whether or not an anomaly of the solenoid proportional valve 140 has occurred, and when an anomaly has occurred, controls the display device 115 to cause the display screen of the display device 115 to display an image representing that an anomaly has occurred, and that the sticking preventing control is not functioning. Thus, the operator can know that the sticking preventing control is not functioning because of an anomaly such as a disconnection or a short circuit in a conductive wire that introduces a current to the solenoid proportional valve 140, occurrence of the sticking phenomenon caused by a lack of an oil film or degradation of the hydraulic working fluid, or the like. Because of this, the operator can appropriately take such a measure for solving the anomaly as an inspection or a repair. Accordingly, malfunctions of the hydraulic actuator caused by sticking of the solenoid proportional valve 140 or the like can be prevented.

Modification Example of Fifth Embodiment

Whereas the display device 115 functions as a notifying device that notifies the operator of an anomaly of the solenoid proportional valve 140 in the example explained in the fifth embodiment, the present invention is not limited to this. The notifying device may be a sound output device such as a speaker that notifies the operator of an anomaly by sound. The notifying device may be a light emitting device having a light emitting element such as an LED that notifies the operator of an anomaly by being turned on, flashing, and so on.

Modification examples like the ones mentioned below are also included in the scope of the present invention, and it is also possible to combine configuration depicted in the modification examples and configuration explained in the embodiments mentioned above, combine configuration explained in different embodiments mentioned above, combine configuration explained in different modification examples below, and so on.

First Modification Example

Whereas the ignition switch 188 as an engine operating section is an engine key switch in the examples explained in the embodiments described above, the present invention is not limited to this. A push type ignition switch may be adopted as the ignition switch 188. With the push type ignition switch 188, it is possible to switch operation states by changing the length of time of pressing operation or the number of times of pressing. For example, if the ignition switch 188 is long-pressed (e.g. for a length of time equal to or longer than 500 msec) when the ignition switch 188 is in the OFF operation state, the ACC relay 194, the IG relay 195, and the starter relay 193 are turned on, and the engine 191 is activated. If the ignition switch 188 is pressed, the switch operation assessing section 162 assesses that the ON operation has been performed. That is, the switch operation assessing section 162 assesses that operation for activating the engine 191 has been performed by the ignition switch 188.

In addition, if the ignition switch 188 is short-pressed (e.g. for a length of time shorter than 500 msec) when the ignition switch 188 is in the OFF operation state, the ACC relay 194 is turned on to be in the ACC ON state. When the ignition switch 188 is short-pressed in the ACC ON state, the IG relay 195 is turned on to be in the IG ON state. When the ignition switch 188 is short-pressed in the IG ON state, the ACC relay 194 and the IG relay 195 are turned off. When the ignition switch 188 is pressed in the ACC ON state, the switch operation assessing section 162 assesses that the ON operation has been performed.

Second Modification Example

Whereas the operation controller 150 executes the sticking preventing control in the examples explained in the embodiments described above, the present invention is not limited to this. The machine body controller 120 and the engine controller 190 may have some of the functions of the operation controller 150. For example, the engine controller 190 assesses, on the basis of a sensing result of the rotation speed sensor 192, whether the engine 191 is in a stopped state or in an operation state, and outputs an assessment result to the machine body controller 120. The machine body controller 120 assesses that the ON operation of the ignition switch 188 has been performed when performing initial setting after electric power starts being fed, and assesses that the current application condition is established when an assessment result representing that the engine 191 is in a stopped state is acquired from the engine controller 190. The machine body controller 120 applies, when assessing that the current application condition is established, a drive current to the solenoid proportional valve 140. In this manner, the sticking preventing control may be executed by cooperation between a plurality of the controllers (controllers) 120 and 190.

Third Modification Example

Whereas the speed threshold Ni is a value equal to or lower than the minimum rotation speed that can be set with the engine control dial 198 (see FIG. 2), and is set to a value greater than the maximum cranking speed of the starter motor 196 in the examples explained in the embodiments described above, the present invention is not limited to this. The speed threshold Ni may be the same value as the speed threshold NO. In this case, since application of a drive current to the solenoid proportional valve 140 stops when cranking is started, influence of the sticking preventing control on machine body behavior can be prevented surely.

Fourth Modification Example

Whereas the solenoid proportional valve 140 has normally-closed (normally-closed) configuration in the examples explained in the embodiments described above, the present invention is not limited to this. The present invention can be applied also to a case where the solenoid proportional valve 140 has normally-open (normally-open) configuration.

Fifth Modification Example

Whereas the valve body of the solenoid proportional valve (solenoid valve) 140 is the spool 142 in the examples explained in the embodiments described above, the present invention is not limited to this. The present invention can also be applied to a solenoid valve having a poppet as the valve body.

Sixth Modification Example

Whereas activation control of the engine 191 is performed when the start operation by using the ignition switch 188 is performed in the examples explained in the embodiments described above, activation control of the engine 191 may be performed only where an engine activation prerequisite is established when the start operation by using the ignition switch 188 has been performed. The engine activation prerequisite is established when the gate lock lever device 185 has been operated to the lock position, for example.

Seventh Modification Example

Whereas the operation device 180 is an electric operation device that controls the solenoid proportional valve 140 in accordance with a control current from the controllers 120 and 150 to generate a command pilot pressure in the examples explained in the embodiments described above, the present invention is not limited to this. The present invention may be applied to a hydraulic pilot type operation device. The hydraulic pilot type operation device is driven directly by an operation lever, and has a pressure reducing valve that outputs a pilot operation pressure according to the operation amount to the directional control valve 130. A solenoid proportional valve that can further reduce the pilot operation pressure is provided between the pressure reducing valve of the operation device and the directional control valve 130 in some cases. In addition, a solenoid proportional valve is provided, via a high-pressure selecting valve, on the pilot line to which the pilot operation pressure generated at the pressure reducing valve of the operation device is introduced, in some cases. In this configuration, the higher one of the command pilot pressure generated at the solenoid proportional valve and the pilot operation pressure generated at the pressure reducing valve of the operation device is introduced to the directional control valve 130. In these types of configuration also, sticking of the solenoid proportional valve can be prevented by executing the sticking preventing control for the solenoid proportional valve.

Eighth Modification Example

Whereas the machine body controller 120 drives the solenoid proportional valve 140 according to the operation amount of the operation device 180 by the operator in the examples explained in the embodiments described above, the present invention is not limited to this. The present invention can be applied also to the sticking preventing control of the solenoid proportional valve 140 used for automated operation control. In this case, for example, the machine body controller 120 drives the solenoid proportional valve 140 in accordance with an action plan set in advance.

Ninth Modification Example

Whereas the operation controller 150 performs ON/OFF control of the various types of relay 193, 194, and 195 on the basis of the operation position of the ignition switch 188 in the examples explained in the embodiments described above, the present invention is not limited to this. The various types of relay 193, 194, and 195 may be configured to be opened and closed mechanically in accordance with pivoting operation of the ignition switch 188.

Tenth Modification Example

Whereas the work machine is the crawler type hydraulic excavator 100 in the cases explained as examples in the embodiments described above, the present invention is not limited to this. The present invention can be applied to various work machines such as wheel type hydraulic excavators, wheel loaders, road machines, cranes, or dump trucks.

Whereas embodiments of the present invention have been explained thus far, the embodiments described above are depicted merely as some of application examples of the present invention, and it is not aimed to limit the technical scope of the present invention to the specific configuration of the embodiments described above.

DESCRIPTION OF REFERENCE CHARACTERS

100: Hydraulic excavator (work machine)
102: Travel structure
102A: Travel motor (hydraulic actuator)
103: Swing structure
103A: Swing motor (hydraulic actuator)
104: Work implement
105: Machine body
107: Tank
110: Hydraulic cylinder (hydraulic actuator)
111: Boom
111A: Boom cylinder (hydraulic actuator)
112: Arm
112A: Arm cylinder (hydraulic actuator)
113: Bucket
113A: Bucket cylinder (hydraulic actuator)
115: Display device (notifying device)
120: Machine body controller (controller)
130: Directional control valve (control valve)
135: Main pump (first pump)
136: Pilot pump (second pump)
140: Solenoid proportional valve (solenoid valve)
142: Spool (valve body)
150: Operation controller (controller)
161: Engine state assessing section
162: Switch operation assessing section
163: Current application condition assessing section
164: Solenoid valve control section
165: Relay control section
180: Operation device
181: Operation sensor
182: Operation lever (operation member)
188: Ignition switch (engine operating section)
189: Temperature sensor
190: Engine controller (controller)
191: Engine
192: Rotation speed sensor
193: Starter relay
194: ACC relay
195: IG relay
196: Starter motor
197: Battery
250: Operation controller (controller)
264: Solenoid valve control section
266: Control current computing section
350: Operation controller (controller)
364: Solenoid valve control section
366: Control current computing section
450: Operation controller (controller)
464: Solenoid valve control section
467: Application time computing section
550: Operation controller (controller)
568: Solenoid valve monitoring section
569: Display control section

The invention claimed is:

1. A work machine comprising:
an engine;
a first pump and a second pump that are driven by the engine;
a hydraulic actuator driven by a hydraulic working fluid supplied from the first pump;
an operation device that operates the hydraulic actuator,
a control valve that controls a flow of the hydraulic working fluid supplied from the first pump to the hydraulic actuator;
a solenoid valve that is driven in accordance with operation of the operation device and reduces a pressure of the hydraulic working fluid supplied from the second pump to generate a pilot pressure for operating the control valve;
a controller that controls the solenoid valve;
an engine operating section that enables operation for activating the engine; and
a rotation speed sensor that senses a rotation speed of the engine, wherein
the controller is configured to
assess whether or not a current application condition is established, the current application condition including that it is assessed, on a basis of a sensing result of the rotation speed sensor, that the engine is in a stopped state, and including that ON operation of the engine operating section is performed in a state where activation operation is not performed by the engine operating section, and including that it is assessed that the operation device is being operated, and
apply a drive current to the solenoid valve to drive the solenoid valve when it is assessed that the current application condition is established.

2. The work machine according to claim 1, wherein
the controller is configured to
stop application of the drive current to the solenoid valve when it is assessed that the engine is in an in operation state, in a state where it is assessed that the current application condition is established, and the drive current is being applied to the solenoid valve.

3. The work machine according to claim 1, wherein
the solenoid valve has a valve body that is stroked between a fully-closed position and a fully-opened position, and
the controller is configured to
apply the drive current to the solenoid valve for a predetermined length of time set in advance to move the valve body to a full stroke position, and keep the valve body at the full stroke position, when it is assessed that the current application condition is established.

4. The work machine according to claim 1, wherein
the controller is configured to
apply the drive current to the solenoid valve repeatedly multiple times when it is assessed that the current application condition is established.

5. The work machine according to claim 1, wherein the work machine includes a temperature sensor that senses a temperature of the hydraulic working fluid supplied to the solenoid valve, and the controller is configured to increase the drive current to be applied to the solenoid valve or increase a length of time of application of the drive current to the solenoid valve as the temperature of the hydraulic working fluid sensed at the temperature sensor lowers.

* * * * *